US005106173A

United States Patent [19]

Kelley et al.

[11] Patent Number: 5,106,173

[45] Date of Patent: Apr. 21, 1992

[54] WORK SPACE MANAGEMENT SYSTEM AND CABINET THEREFOR

[75] Inventors: James O. Kelley, Spring Lake; Robert L. Beck, Zeeland; Jerry A. DeFouw, Grand Rapids; Andrew J. Kurrasch, Saugatuck; George A. Williams, Hudsonville, all of Mich.; Geoffrey A. Hollington, London, England

[73] Assignee: Herman Miller, Inc., Zeeland, Mich.

[21] Appl. No.: 657,076

[22] Filed: Feb. 15, 1991

Related U.S. Application Data

[62] Division of Ser. No. 205,307, Jun. 10, 1988, abandoned.

[51] Int. Cl.[5] ..... A47B 88/00

[52] U.S. Cl. ..... 312/111

[58] Field of Search ..... 312/257.1, 265.1-265.4, 312/111, 107

[56] References Cited

U.S. PATENT DOCUMENTS

| | | |
|---|---|---|
| 1,700,203 | 1/1929 | Baker . |
| 2,520,506 | 8/1950 | Mankki . |
| 3,067,882 | 12/1962 | Ribbens et al. . |
| 3,112,912 | 12/1963 | Alvarez . |
| 3,542,446 | 11/1970 | Joyce . |
| 3,563,624 | 2/1971 | Stice . |
| 3,791,528 | 2/1974 | Brendgord . |
| 4,008,872 | 2/1977 | Thompson . |
| 4,021,973 | 5/1977 | Hegg et al. . |
| 4,034,864 | 7/1977 | Tyson et al. . |
| 4,174,486 | 11/1979 | Winkler . |
| 4,274,687 | 6/1981 | Bayles et al. . |
| 4,415,091 | 11/1983 | Wolff . |
| 4,457,436 | 7/1984 | Kelley . |
| 4,571,907 | 2/1986 | DeFouw et al. . |
| 4,605,988 | 8/1986 | Nienhuis et al. . |
| 4,618,192 | 10/1986 | Kelley . |
| 4,632,473 | 12/1986 | Smith . |
| 4,685,255 | 8/1987 | Kelley . |

FOREIGN PATENT DOCUMENTS

| | | | |
|---|---|---|---|
| 1255516 | 1/1960 | France | 312/111 |

*Primary Examiner*—Joseph Falk

*Attorney, Agent, or Firm*—Varnum, Riddering, Schmidt & Howlett

[57] ABSTRACT

A work space management system including free-standing walls and a freestanding cabinet integrated into the wall system and separate from the wall system. The cabinet comprises side wall and back wall channels having vertically spaced openings therein and a connector means to mount the cabinet to a vertical frame member of the freestanding walls or to another cabinet through the indented channel openings. The cabinet further comprises rear frame members having vertically spaced openings for hanging shelving or other articles. The cabinet is also adaptable for having horizontal work accessory support rails. The sides of the cabinet are mounted onto a rigid framework. Wire management capability is provided in the cabinet to interface with wire management in the freestanding walls.

22 Claims, 15 Drawing Sheets

WORK SPACE MANAGEMENT SYSTEM AND CABINET THEREFOR

This is a division of Ser. No. 205,307, filed Jun. 10, 1988, now abandoned.

THE FIELD OF THE INVENTION

The invention relates to work space management system and cabinets which can integrated into such systems. In one of its aspects, the invention relates to freestanding cabinets adapted to integrate into a workspace management system comprised of freestanding walls. In another of its aspects, the invention relates to a work space management system having a freestanding cabinet incorporated into a freestanding wall and providing a return therefor.

BACKGROUND OF THE INVENTION

Wall-mounted cabinets that attach to a freestanding wall are known. For example, U.S. Pat. Nos. to Kelley, 4,618,192, issued Oct. 21, 1986 and Aylworth, Re. 28,994, reissued Oct. 5, 1976 disclose a cabinet adapted to mount to a freestanding wall by hooks secured to the cabinet and engage vertical standards mounted to the wall. Freestanding cabinets having adjustable shelving are also known. U.S. Pat. Nos. to Bayles et al., 4,274,687 issued Jun. 23, 1981, Winkler, 4,174,486, issued Nov. 13, 1979, and Ribbens et al., 3,067,882, issued Dec. 11, 1962 are representative of patents disclosing cabinets having adjustable shelving. For example, in Bayles et al., there is a cabinet having a back wall which includes vertical slotted standards and horizontal hanger rails. Storage bins are mounted onto the rails. Shelves are secured to the upright slotted standards in the conventional manner. The storage bins have, at the back portions thereof, depending lips which engage the rails.

Kelley et al, in U.S. Pat. No. 4,685,255, issued Aug. 11, 1987, discloses and claims a work space management system in which rigid frames are rigidly joined together at facing edges and wire management is provided from frame to frame at the bottom and mid-portions thereof. It is usually desirable to configure the walls at right angles to provide a return to give lateral, binding moment stability to long runs of such walls.

SUMMARY OF THE INVENTION

According to the invention there is provided a cabinet for use in combination with a frame having an edge face through which two of the frames are joined together, the frames having at least one opening. The cabinet comprises a back wall, first and second sidewalls, a top wall and a bottom wall, all joined together to form an integral open front unit. A cabinet indented channel extends vertically along at least one of the back or side walls and openings are provided in the base of the indented channel. A connector is adapted to mount in the cabinet indented channel to fit in the frame opening and to secure at least one of the frames to the cabinet.

Preferably, the frame opening is in an edge face of the frame and the connector has a block shaped to pass through the opening in the frame in one orientation and unable to pass through the opening in the frame in a second orientation. A retainer is adapted to mount in the cabinet indented channel and grips the block. A collar is adapted to abut the frame and has an opening to permit the retainer grip to pass therethrough. The retainer has an opening extending therethrough and the block has a fastener receiver. The fastener has a longitudinal axis adapted to pass through the opening in the cabinet channel and to be retained therein, to pass through the openings in the retainer and collar and to adjustably grip the fastener receiver in the block to draw the block tightly into engagement with the frame in the second orientation and to draw the frame tightly into contact with the cabinet in perpendicular orientation to the cabinet wall having the cabinet indented channel therein.

Preferably, a second connector is adapted to mount in the cabinet indented channel and to secure to identical cabinets in side-by-side, back-to-back or side-to-back relationship.

In another embodiment, the connector comprises a bock shaped to pass through the frame opening in one orientation and unable to pass through the frame opening in a frame in a second orientation. The block further has a fastener receiver. A retainer has an opening therethrough for receiving a fastener. A first fastener has a longitudinal axis and is adapted to pass through the retainer opening and to be retained therein, to pass through the frame opening and to adjustably grip the block fastener receiver. A blade is coupled to the retainer, extends outwardly thereof and is adapted to extend from a corner of the cabinet to the cabinet indented channel. The opening of the blade is adapted to register with the indented channel. A second fastener is adapted to extend through the openings in the cabinet indented channel and through the blade to secure two of the cabinets together and to a frame in abutting relationship with corners of the cabinet adjacent to the cabinet indented channels in respective cabinets.

In another embodiment, a first indented channel extends vertically along the back wall of the cabinet near the side edges thereof and a second indented channel extends along first and second sidewalls near an edge adjacent to the back wall. A second connector is adapted to mount in the first and second indented channels to connect multiple of the cabinets together in back wall-to-back wall, sidewall-to-sidewall or back wall-to-sidewall relationship.

Preferably, the connector includes a resilient pad for mounting an edge face of the frame in abutting relationship to the cabinet and having an opening therein for registry with the frame opening. The connector further includes a fastener adapted to extend through one of the indented channel openings and into fastening relationship with the one frame opening.

Preferably, vertical support members are positioned at the back portion of the cabinet and have a series of vertically spaced slots for receiving bracket hooks to support shelves and the like. The cabinet is preferably formed of a rigid framework of vertical frame members positioned at vertical corners of the cabinet and horizontal frame members positioned at upper and lower ends of the vertical members. Means are provided for mounting the back wall, first and second sidewalls, top wall and bottom wall to the rigid framework.

In accordance with another embodiment of the invention, a work surface having at least one leg at one end thereof is mounted to one of the cabinet walls. A plate which is received within a cabinet indented channel and a stud which is received within an opening in the vertical channel mount the work surface to the cabinet back wall.

The invention also contemplates a storage cabinet wherein connectors are adapted to mount in the cabinet indented channels and to secure two of the cabinets together in side-to-side, back-to-back or side-to-back relationship.

The cabinets are further provided with vertical hanging intelligence within the cabinets so that shelves and the like can be attached to the cabinets. This vertical hanging intelligence is preferably provided on vertical frame members of the cabinet. Further, work surfaces and the like can be at least partially suspended from the cabinet back wall through the indented channels and connector means. Wire management means are preferably provided on a lower portion near the back wall to interface with wire management at lower portions of the freestanding walls.

The cabinet is preferably constructed of a rigid framework formed of rigid vertical frame members at the corner of the cabinet and horizontal frame members positioned at upper and lower ends of the vertical frame members. The walls are hung onto the rigid framework. At least some of the rigid vertical frame members preferably have vertically spaced slots for receiving bracket hooks to support shelves and the like within the cabinet. The rigid vertical frame members also have openings in registry with the openings in the cabinet indented channels.

The cabinet and connectors according to the invention provide a very versatile cabinet which can function as a return for freestanding wall frames and eliminate the necessity for such returns. Further, the versatility of the cabinets permits many different configurations to suit the user and significantly enhances the variety of the work space management system.

BRIEF DESCRIPTION OF THE DRAWINGS

Reference will now be made to the drawings in which:

FIG. 25(*a*) is a perspective view of a multipurpose connector;

FIG. 25(*b*) is an exploded plan view in section of the wa cabinet shown in FIG. 13 and illustrating the manner of mounting the multipurpose connector;

FIG. 25(*c*) is an exploded plan view in section of portions of a pair of cabinets and the multipurpose connector of FIG. 25(*a*) and illustrating the manner in which the portion of the back walls opposite the wall shown in FIG. 14 can be joined by the multipurpose connector;

DETAILED DESCRIPTION OF THE PREFERRED EMBODIMENT

Figure 1:
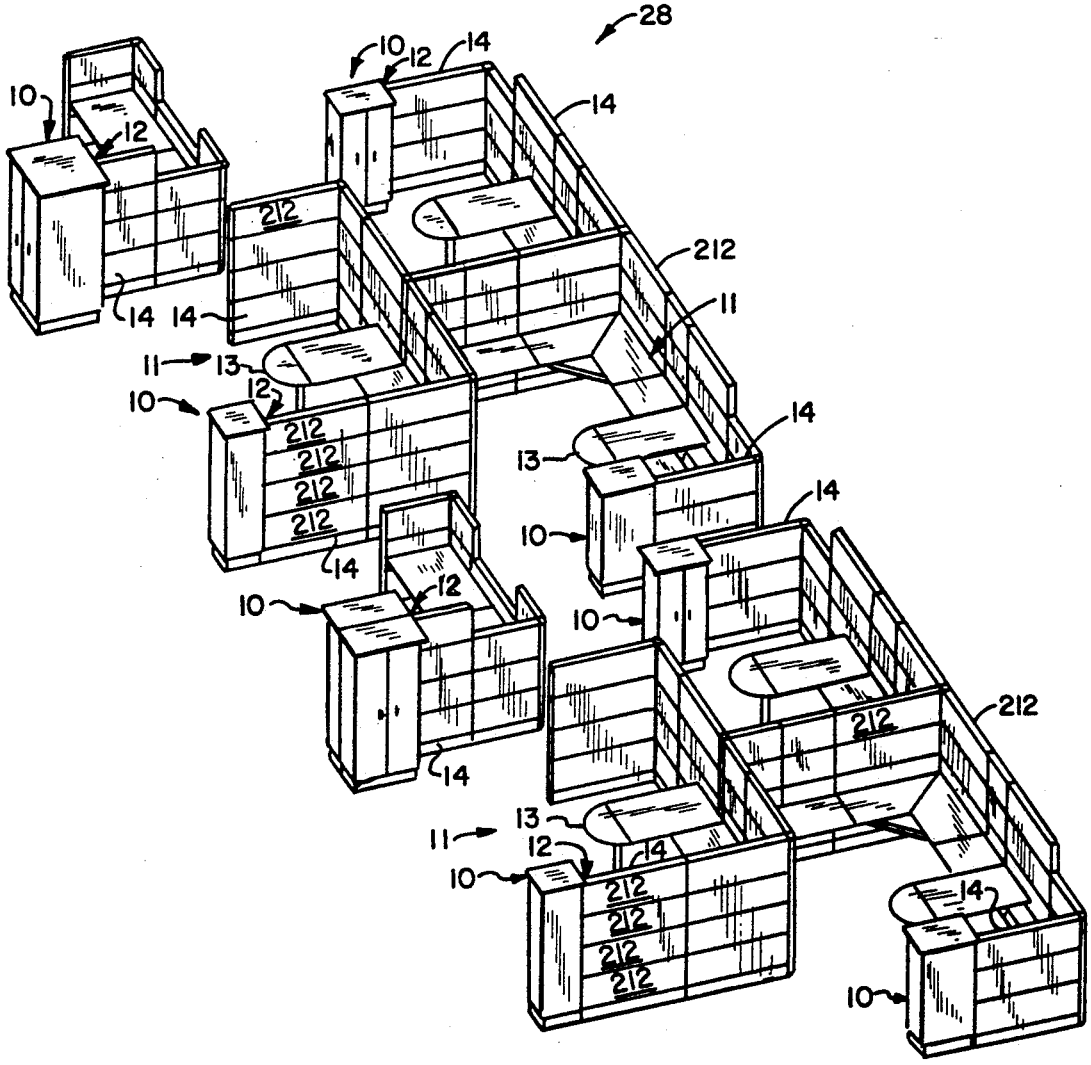
FIG. 1 is a perspective view of a work space management system according to the invention.

Referring to the drawings and particularly to FIG. 1, there is shown a storage cabinet 10 that can be placed in a freestanding position or can be mounted to other cabinets or to freestanding walls 14 comprising part of an office system or work space management system 28 of a so-called "modular" type. One such office system is disclosed in U.S. Pat. No. 4,685,255 to Kelley et al., issued Aug. 11, 1987, and manufactured and sold under the trademark ETHOSPACE, by Herman Miller, Inc., of Zeeland, Mich. The office system may comprise work spaces 11. The cabinet 10 has means to be attached to other cabinets or to wall panels in various arrangements to adapt the cabinet for use in differing work environments. Work surfaces 13 are positioned within the work spaces 11 and can be attached to the freestanding walls 14 in the manner disclosed in the Kelley et al. U.S. Pat. No. 4,685,255.

Referring to FIG. 1 to 4, there is shown the storage cabinet 10 comprising a plinth 16, a back wall 20, side walls 22, a pair of front doors 26 mounted for movement between an open and a closed position, a plinth top wall 52 serving as a cabinet bottom wall, and a cabinet top wall 120. The walls and doors define an interior 24 used as a storage area. There are also side wall channels 194 and back wall channels 196 that function as a part of a connection means 12 to removably integrate the cabinet to the workspace management system 28 comprising the freestanding walls 14, or to other cabinets as will be hereinafter described in detail. There is also a locking means 30 to lock the doors in a closed position. The cabinet may also include an optional pocketing means 32 for storing the doors 26 within the cabinet when the doors are in an open position.

Figure 4:
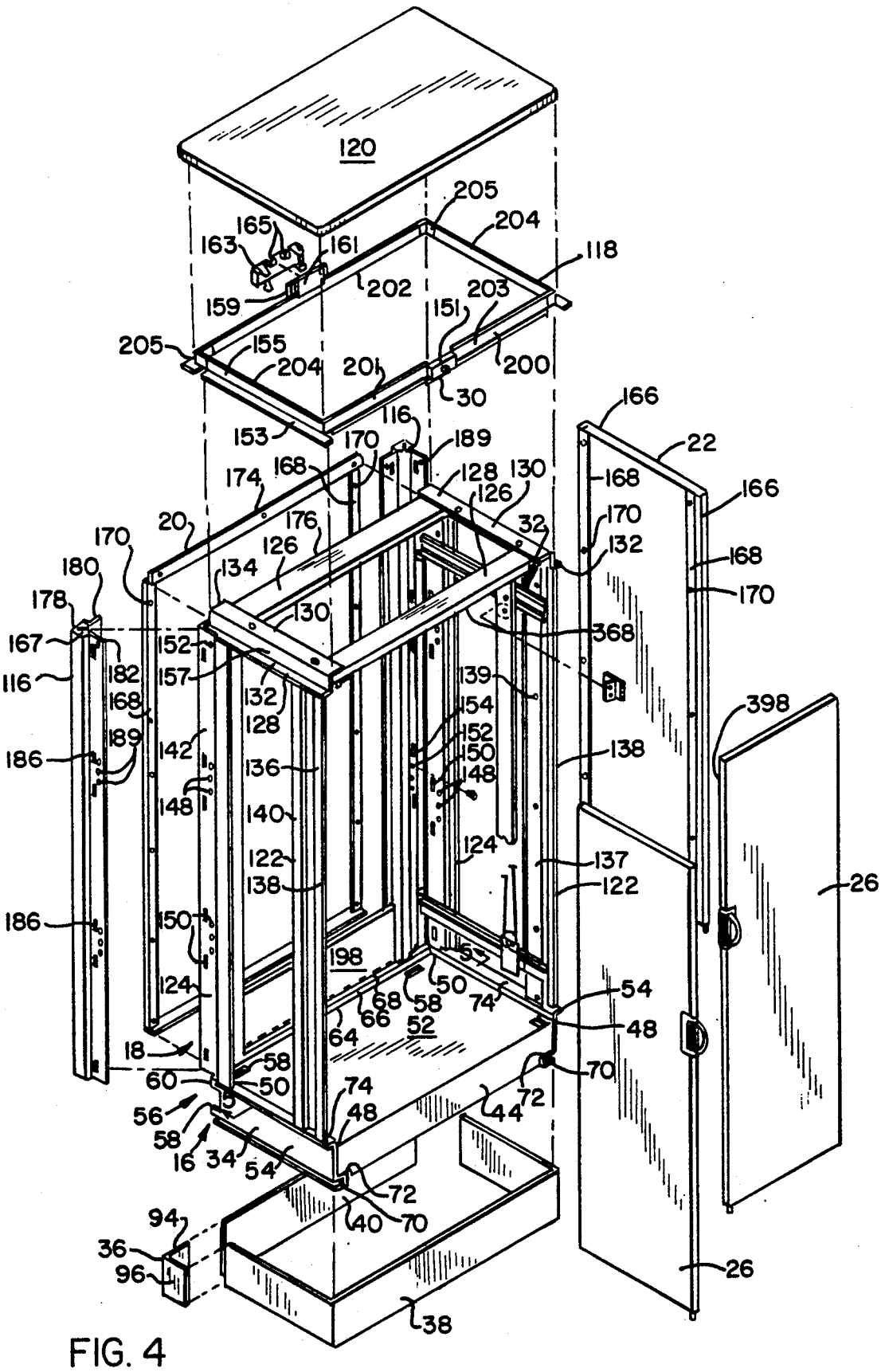
FIG. 4 is an exploded perspective view of the cabinet shown in FIGS. 2 and 3.
Figure 2:
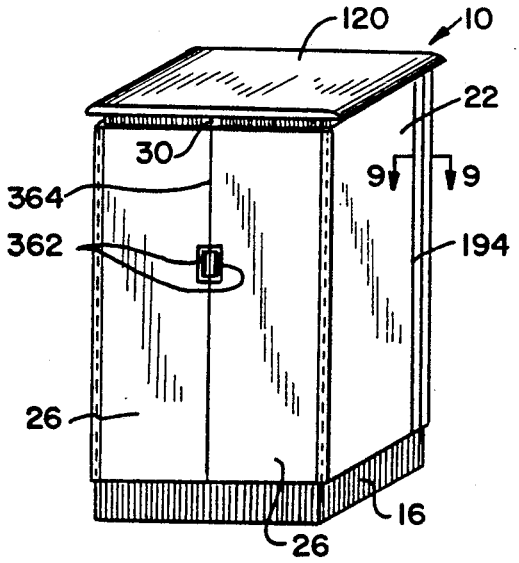
FIG. 2 is a front perspective view of a cabinet in accordance with the invention.
Figure 3:
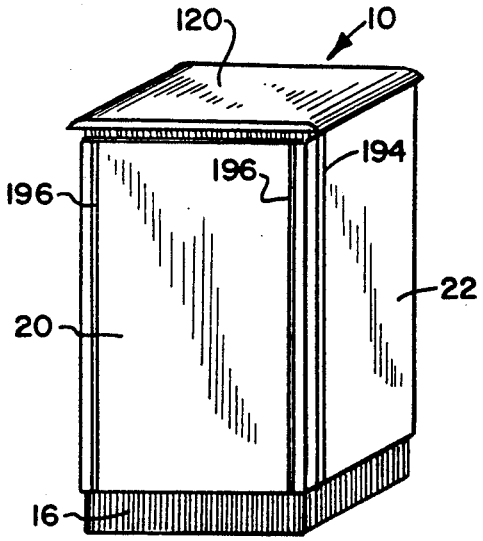
FIG. 3 is a rear perspective view of the cabinet shown in FIG. 2.
Figure 5:
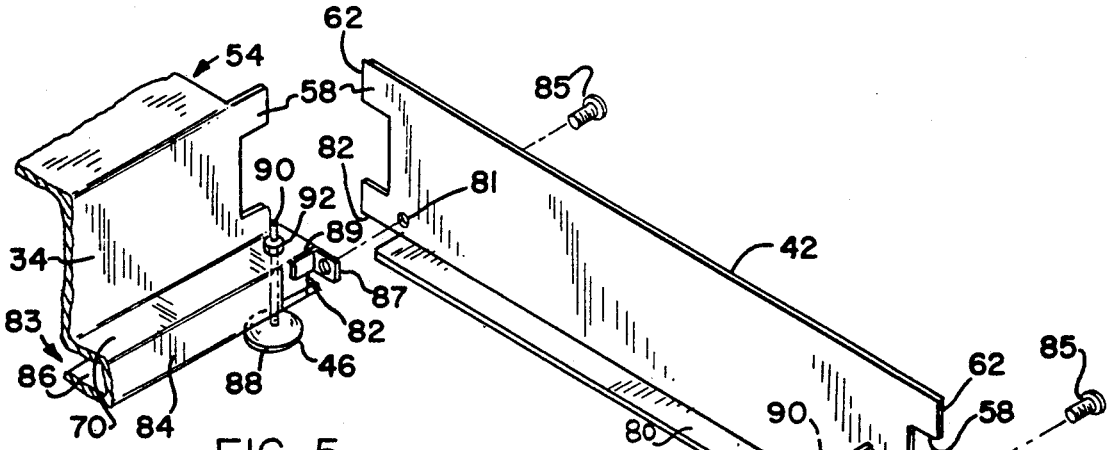
FIG. 5 is a partial exploded view in section taken along line 5—5 in FIG. 4 and showing a back plate.

As illustrated in FIGS. 4 and 5, the plinth comprises a rectangular boxlike frame 34, a pair of removable covers 36 mounted at rear corners of the frame, a pair of nonremovable front and rear covers 38, 40 affixed to back and front walls 42, 44 of the frame, respectively, and a glide means 46 mounted on the bottom of the frame at front and rear corners 48, 50. The glide means 46 functions to support the cabinet and can be adjusted for leveling "the same. The plinth 16 functions to support the cabinet on the floor.

The plinth frame 34 is preferably made of steel and comprises the top 52 formed integrally with the front wall 44. In addition, the frame comprises two generally Z-shaped side walls 54 rigidly fastened as by welding to the top 52 and front 44. As best seen in FIG. 5, a plinth side wall lower flange 70 has attached thereto a downward extending flange 84 and an optional return portion 83 comprising flange 84 and a return flange 86 extending parallel to flange 70.

Figure 6:
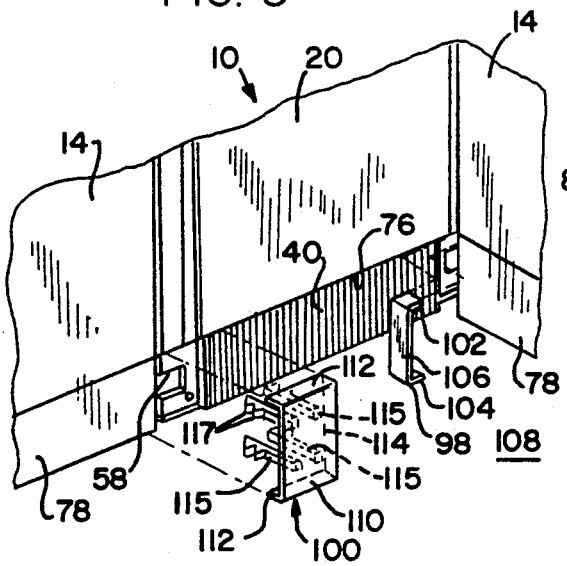
FIG. 6 is a fragmentary perspective view of a bottom portion of the cabinet mounted to wall panels and showing junction covers.

As seen in FIG. 5, the plinth back wall 42 is removably fastened to the side walls 54. Specifically, screws 85 are threadably mounted through holes 81 in the back wall 42 to brackets 87 that are welded to an inside edge 89 of the side wall lower flange 70. A pair of cutouts 82 in the back wall 42 prevent interference with the side wall flanges 84. The plinth back wall is removable so as to permit wiring (not shown) to extend through and be stored within the plinth frame. The plinth has channels for accommodating electrical wiring in the office system. An access means 56 comprising cutouts 58 extending through rear edges 60 of the plinth side walls 54 and rear corners 50 of the top wall 52 and lateral edges 62 of the plinth back wall 42 provides access to the above-stated wiring within the plinth 16 and the interior portion 24 of the cabinet. The cutouts 58 further register with wire management channels in the freestanding walls baseline covers 78 (FIG. 6).

Figure 7:
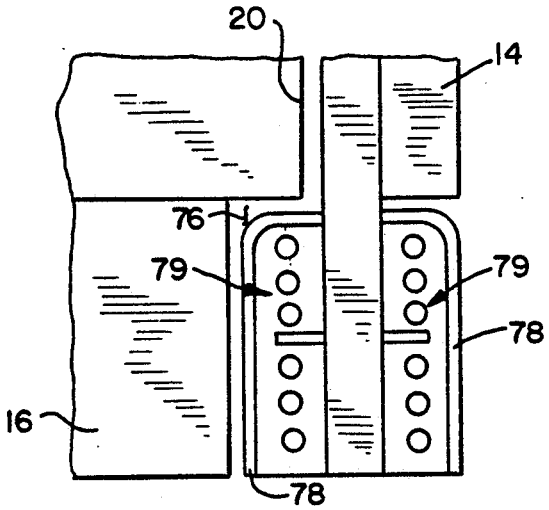
FIG. 7 is a partial side elevational view of a lower rear portion of the cabinet and a wall panel abutting the cabinet in perpendicular relationship thereto.

A rear portion 64 of the plinth top wall 52 comprises two right-angle bends forming upwardly and rearwardly extending flange portions 66, 68. The lower Z-shaped side wall flange 70 registers with a matching cutout 72 at the bottom of the front wall 44. Upper flanges 74 of the side walls and the rearward top wall flange 68 are equal in height and function to support a cabinet rectangular boxlike frame 18 as will be hereinafter described in detail. The side wall upper flange 74 terminates at a predetermined distance from the rear portion of the plinth top wall. In this manner, the plinth side walls 54, the top wall rearward flange 68 and the plinth back wall 42 define a recess 76 which provides clearance for a wall panel baseline cover 78 as shown in FIG. 7, as will hereinafter be described in detail. The plinth top 52 functions as the cabinet bottom wall which defines, in part, the cabinet interior storage area 24.

The glide means 46 comprises a plurality of feet 88, each having a threaded stud 90 to adjustably mount the foot to a threaded bushing 92 in the bottom flange 70 of the Z-shaped side wall 54. Specifically, as seen in FIG. 5, the bushing is vertically positioned at each corner of the side walls 54. The flange 70 may be reinforced with another piece of metal stock. The stud 90 threadably mounts to the bushing so the cabinet can be leveled on an uneven floor.

As seen in FIG. 4, the plinth front wall 44, side walls and back wall 54, 42 are covered by the front and rear nonremovable, aesthetic functioning covers 38, 40, respectively. The removable covers 36 comprise part of the access means 56 and attach to the rear corners 50 of the plinth frame in a snap-fit relationship as will be hereinafter described in detail. The covers 36 cover a portion of the back wall 42, the side walls 54 and the cutouts 58. The removable covers comprise two rectangular portions 94, 96 set at right angles to match the geometry of the plinth corners. The removable covers are placed over the rear corners 50 to cover the cutouts 58 if it is not desired to install electrical wiring into the cabinet 10.

The rear nonremovable cover 40 comprises a rectangular segment secured to the plinth back wall 42. The front nonremovable cover 38 comprises a U-shaped segment mounted to the plinth front and side walls. The covers 38, 40 the securely fastened as by an adhesive means to the plinth. The removable and non-removable covers are preferably made of a cast flexible polyvinyl chloride (PVC) plastic material.

If the optional plinth return flange 86 is not used, a rectangular-shaped block (not shown) may be placed beneath the plinth lower side wall flange 70 to facilitate placement of the front nonremovable cover 38. The block (not shown) may be made of any suitable material such as metal, plastic, or wood and is mounted to the cabinet by inserting the glide stud 90 through apertures located at each longitudinal end of the block. The block functions to prevent the cover 38 from curling beneath the plinth flange 70 along the plinth side walls 54.

As illustrated in FIG. 6, there is a corner junction cover 98 and a colinear junction cover 100 adapted to mount to the baseline of the cabinet-wall or cabinet-cabinet interfaces in the event the removable covers are removed to accommodate wiring (not shown). Specifically, the junction covers 98, 100 cover a gap that would otherwise exist between the freestanding wall baseline cover 78 and the plinth rear plinth cover 40.

The corner junction cover 98 is U-shaped, comprising upper and lower parallel leg portions 102, 104 and a bight portion 106. The cover 98 is mounted within the plinth recess 76 and held in place between the plinth 16, the baseline cover 78 and a floor 108 by attaching adhesive tape to and between the cover 98 and the baseline cover. The bight portion 106 is oriented vertically. The corner junction cover 98 is used at locations where the plinth is perpendicular to an adjacent freestanding wall 14 or cabinet such as where a corner of the workspace management system 28 is formed. In this manner, the corner junction cover 98 provides continuity between the plinth 16 and the wall baseline cover 78 or adjacent cabinet plinth cover 16.

As seen in FIG. 6, the colinear junction cover 100 comprises a web portion 110, a pair of parallel sides 112 one lateral side 114 extending perpendicular to the web portion in the same direction relative thereto and a plurality of fingers 115 having projections 117. The colinear cover is used at locations where the wall 14 and cabinet 10 are colinear. The function of the lateral side 114 is to fill a gap that would otherwise exist between the plinth rear non-removable cover 40 and the web portion 110 resulting from the recess of the cover 40 from the surface of the cabinet back wall 20.

The junction cover 100 is installed by a snap fit means. Specifically, the fingers 115 engage the cutouts 58 in the plinth frame back wall 42 or alternatively, engage rear portions of the plinth side wall 54. An alternate means (not shown) of mounting the cover 100 comprises mechanically fastening as by screws the cover 100 to the plinth back wall 42.

Similarly, the snap fit means for the removable covers 36 may comprise fingers (not shown) which engage the plinth frame 34. Alternatively, the removable covers 36 may be mechanically fastened as by screws to the plinth frame.

As illustrated in FIG. 7, wire management means 79 are provided behind the covers 78 and are directly aligned with the cutouts 58 at the sides or back wall of the cabinet. The wire management means 79 of the freestanding walls 14 are more fully described in the Kelley et al U.S. Pat. No. 4,685,255, which is incorporated herein by reference.

As illustrated in FIG. 4, the cabinet further comprises the boxlike frame 34 supported on the plinth top and side wall flanges 68, 74. The cabinet back and side walls 20, 22, a pair of rear corner members 116, doors 26, an upper reveal 118 and the cabinet top 120 are mounted to the framework 34 through screws as will be described later.

The cabinet framework 18 comprises pairs of front vertical members 122, rear vertical members 124, upper transverse cross members 126, and upper Z-shaped in cross section members 128. The front vertical members 122 are rigidly fastened as by welding the plinth side wall upper flanges 74. The rear vertical members are rigidly fastened to the flange 74 and the plinth top rearwardly directed flange 68. The upper Z-shaped members 128 are horizontally oriented and have upper and lower flanges 130, 132, respectively. The lower flange is rigidly mounted to upper axial ends of its respective vertical members 122 and 124. The cross members are rigidly mounted to the Z-shaped member upper flanges 130. The lower flange 132 of each Z-shaped member terminates at a predetermined distance from the member rear edge 134. The Z-shaped members 128 and upper cross members 126 provide lateral support for the cabinet 10 and support the cabinet top 120 and the upper reveal 118. The entire framework functions to provide structural rigidity for the cabinet 10.

Each front vertical frame member 122 comprises a U-shaped central portion 136 and bilateral flanges 138, 140. The bight portion 137 of the U-shaped portion 136 has a vertically spaced series of holes 139 for mounting thereto a cabinet side wall 22, the manner of such mounting being described hereinafter in detail.

Figure 9:
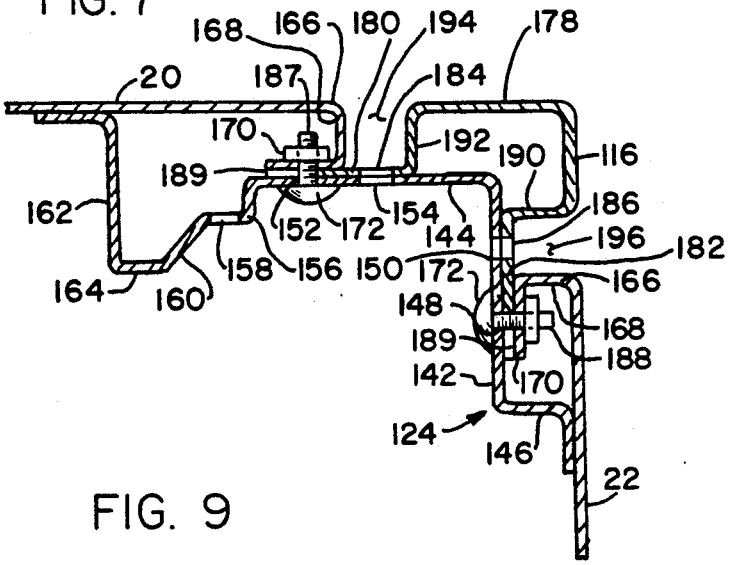
FIG. 9 is an enlarged sectional view taken along line 9—9 of FIG. 2.
Figure 8:
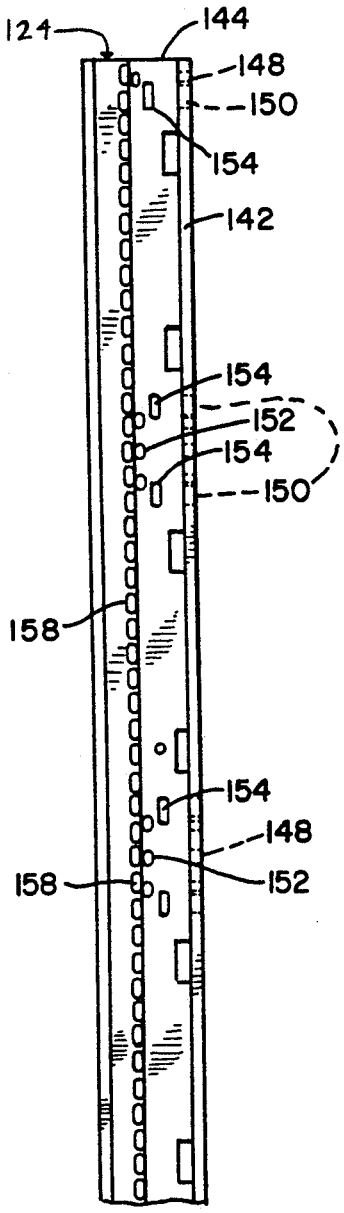
FIG. 8 is an enlarged front elevational view a portion of a rear vertical frame member of FIG. 4.
Figure 10A:
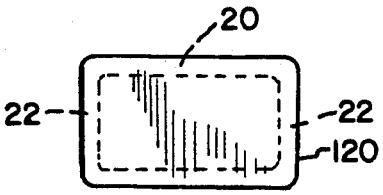
FIGS. 10(*a*) through 10(*d*) are plan views of the cabinet showing various top wall arrangements.
Figure 10B:
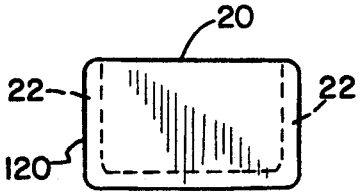
Figure 10C:
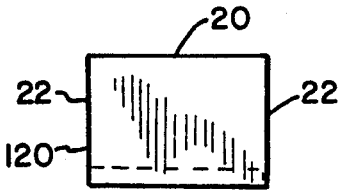
Figure 10D:
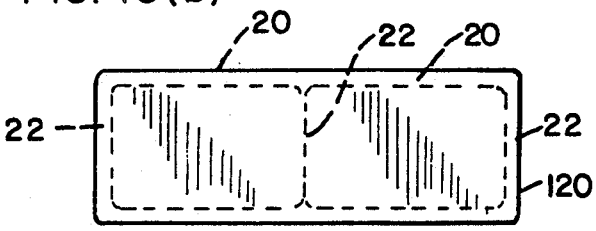

As best seen in FIGS. 4, 8, and 9, each rear vertical frame member 124 comprises a first leg 142 extending parallel with the cabinet side wall 22, and a second leg 144 set perpendicular to the first leg and extending parallel with the cabinet back wall 20. The first leg 142 forms a step portion at an outer end 146 thereof, engaging the cabinet side wall and providing additional support to the side wall to resist externally imposed forces exerted on the wall. The first leg also includes a vertically spaced series of holes 148 and a series of vertically spaced openings 150. The holes 148 form a part of the means for attaching the side wall 22 to the rear vertical member 124 as will be hereinafter described in detail. The openings 150 function to connect the cabinet 10 to a freestanding wall 14 or another cabinet **10*a*** as will also be described later in detail.

The second leg 144 also includes a series of vertically spaced holes 152 and a series of vertically spaced openings 154. The holes 152 form a part of the means for attaching the back wall 20 to the rear vertical member 124 as will be hereinafter described in detail. The openings 154 function to connect the cabinet 10 to a wall panel 14 or another cabinet **10*a* as will also be described later in detail. The second leg 144 has two step portions. A first step portion 156 includes a plurality of vertically spaced holes 158 which function to hang conventional brackets within the cabinet 10 as is described later in detail. A sloping portion 160 adjacent the first step portion 156 functions to guide the article hook means into registry with the holes. A second step portion 162 at an outer end 164 of the second leg 144 engages the cabinet back wall 20** and functions to provide additional support for the back wall to resist externally imposed forces on the wall.

As seen in FIGS. 2–4 and 9, the cabinet back and side walls 20, 22 comprise rectangular-shaped surfaces preferably made of a textured metal skin and optionally including a layer of soundproofing (not shown). Vertical ends 166 of each wall include two right-angle bends forming a return portion 168. The return portions have a series of vertically spaced holes 170 aligned with the holes 139, 148, 152 in the respective front and rear vertical frame members 122, 124. Bolts 172 are used to connect the back and side walls 20, 22 to the vertical frame members. The back wall 20 has an upper flange 174 mechanically fastened to the upper framework rear cross member rear edge 176 by bolts (not shown) that extend through aligned holes (not shown) in the flange and rear cross member 126.

As illustrated in FIGS. 4 and 9, each corner member 116 comprises a boxlike central member 178 having first and second flange portions 180, 182, respectively. The flanges are normal to one another and extend laterally of the central member 178. Each flange has a series of vertically spaced openings 184, 186, respectively, aligned with the openings 154, 150, respectively, in the rear vertical frame member 124. The flange 180 of each corner member is positioned between the return portion 168 of back wall 20 and the second leg 144 of the rear vertical frame member. The flange 182 is positioned between the return portion 168 of side wall 22 and the first leg 142 of the rear vertical frame member 124. There is also a series of vertically spaced notches 189 located along the corner member flanges 180, and 182. As seen in FIG. 9, bolts 188 extend through the holes 148 in the leg 142, notches 189 in flange 182, and holes 170 in the side wall return portion 168 to attach the side wall 20 and the corner member 116 to the rear vertical frame member 124. In similar fashion, bolts 187 extend through the holes 152 in the leg 144, notches 189 in flange 180, and holes 170 in the back well return portion 168 to attach the back wall 20 and the corner member 116 to the rear vertical frame member 124.

As seen in FIG. 9, the corner member side wall 190, the corner member flange 182, and the return portion 168 of the sidewall 22 form the side wall channel 194 having aligned openings 150, 186 extending therethrough. The corner member side wall 192, the corner member flange 180, and return portion 168 form the back wall channel 196 having aligned openings 154, 184 extending therethrough.

Referring to FIG. 4, a rectangular-shaped counterweight 198 is securely fastened as by welding to and between the rear vertical frame members 124 and the flange 68 in the plinth top 52. The counterweight, preferably made of metal, provides stability for the cabinet 10 by lowering its center of gravity.

As seen in FIG. 4, surrounding the upper horizontal framework is the upper reveal 118 which provides an aesthetic covering for the upper portion of the cabinet frame. The reveal 118 comprises a front wall 200, a back wall 202, a pair of side walls 204 and corner pieces 205. The locking means 30 is interposed in the middle portion of the reveal front wall. The reveal front wall 200 comprises first and second portions 201, 203 between which is interposed the lock 30. The front wall has a rearward extending horizontally oriented flange (not shown) that functions to mount the wall 200 to the cabinet cross member 126 by any suitable mechanical means such as screws. A lock cover 151 may be mounted over the lock to further enhance the aesthetics of the cabinet 10. The cover 151 may be mounted by any suitable means such as by having a cover pin (not shown) extend through the lock and retained thereto by a pin retainer (not shown) mounted on the pin portion, extending into the cabinet interior. The reveal front wall 200 and lock cover 151 are preferably made of an extruded plastic material.

The reveal side walls 204 comprise a bottom flange portion 153 mounted by pins (not shown) received within mating holes in the lower flange 132 of the framework upper Z-shaped member 128 and a nonremovable cover 155 mounted to the vertically oriented portion 157 of the Z-shaped frame member 128 as hereinafter described in detail. The side walls 204 are preferably made of an extruded plastic material.

The reveal back wall 202 comprises a rectangular strip mechanically fastened as by pins on screws to the rear cabinet frame cross member 126. A raised central portion 159 has a rectangular-shaped aperture 161 therethrough. The aperture 161 functions to enable wiring (not shown) to enter the cabinet 10 from above. After wiring is fed into the cabinet, a rectangular-shaped access plug 163 is releasably fastened by a snap fit means to cover the aperture 161 A pair of openings 165 in the access plug 163 enable the wiring to extend into the cabinet 10, the reveal back wall is preferably made of steel, while the access plug is preferably made of a plastic material.

Reveal corner pieces 205 cover the upper edges 167 of the cabinet corner members 116 and the rear corners of the cabinet Z-shaped frame member 128. Pins (not shown) extend beneath the corner pieces 205 and are releasably mounted within receiving holes (not shown) in the upper edge of the corner member 116.

The nonremovable reveal cover 155 functions as an aesthetic covering for the reveal 118 and as a portion of the reveal side walls 204. The reveal cover comprises a one-piece member preferably made of cast PVC material having the same appearance as the plinth covers 36, 38 and 40. The reveal cover 155 is bonded to the vertical portions of the reveal front wall 200, back wall 202, and corner pieces 205 and to the vertical portion 157 of the Z-shaped frame member 128.

The cabinet top 120 is rectangular in shape and is securely fastened as by screws to the Z-shaped upper frame member upper flange 130 as seen in FIG. 4. As illustrated in FIGS. 10(*a*)–10(*d*), the top may be made to oversail the cabinet and is preferably made of a material such as fiberboard.

As shown in FIGS. 1–3, 11–16, and 29–31, the cabinet 10 can be freestanding in a modular or non-modular office arrangement if so desired. The cabinet can be used to store articles, clothing, office accessories, etc. Alternatively, the cabinet can be integrated into a modular workspace management system, such as that disclosed in the above-referenced patent to Kelley and in U.S. Pat. No. 4,571,907 to DeFouw et al., issued Feb. 25, 1986.

Figure 17:
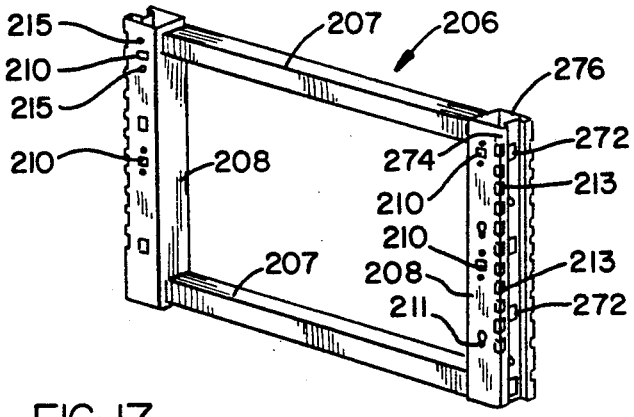
FIG. 17 is a perspective view of a free-standing wall frame.
Figure 21:
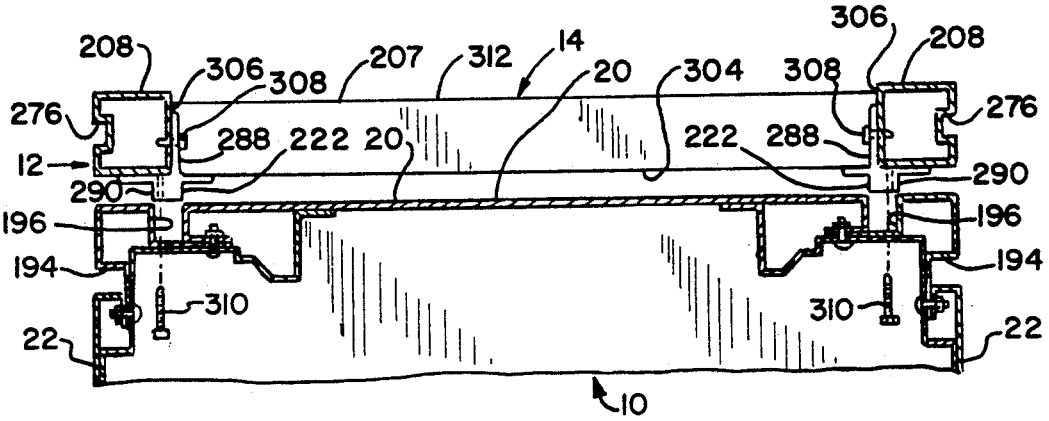
FIG. 21 is an exploded plan view in section of the wall and cabinet shown in FIG. 13 and illustrating the manner of mounting the face connector of FIG. 20.

Referring to FIGS. 1, 17 and 21, a typical modular workspace management system 28 comprises a plurality of individual freestanding walls 14 having rigid rectangular frames 206, comprising horizontal frame members 207 and vertical frame members 208. The frames are removably fastened together at adjoining vertical frame members in accordance with the joining system shown in the above-referenced U.S. Pat. No. 4,571,907. Electrical wiring (not shown) can be installed within channels (not shown) in a lower portion of the frame 206. Wall tiles 212 removably attach to the frames to complete the wall system in a manner disclosed in the above-referenced Kelley et al. U.S. Pat. No. 4,685,255. Specifically, the wall tiles have clips and hooks (not shown) that mount to mating holes 210 and slots 211 in the vertical frame member 208. A second set of slots 213 is positioned along the corner of the vertical frame member and curve to receive hooks for hanging shelves or work surfaces. In addition, there are a pair of holes 215 in spaced relationship to each hole 210.

The cabinet 10 attaches to the wall vertical frame members 208 by the connection means 12. Specifically, the connection means permits the cabinet 10 to be integrated into the workspace management system 28 so the cabinet back or side walls 20, 22 form part thereof. As representatively illustrated in FIGS. 11 to 15, cabinets may be positioned so a freestanding 14 wall is either parallel or perpendicular to the cabinet back wall 20. Walls 14 can connect to rear portions 214 of the side walls 22 and/or to outer portions 216 of the back wall 20 as will be hereinafter described in detail.

Figure 14:
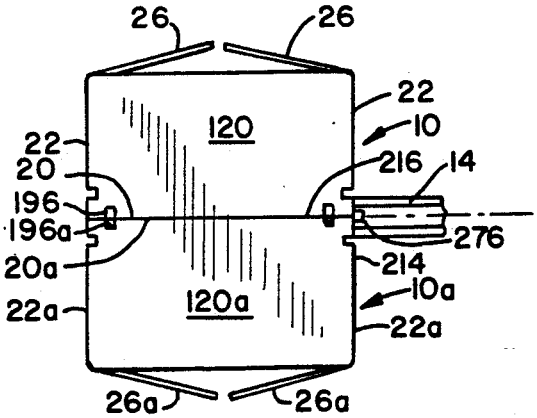
FIG. 14 is a schematic plan view of a first arrangement of a pair of cabinets in back-to back relationship and connected to a freestanding wall.
Figure 15:
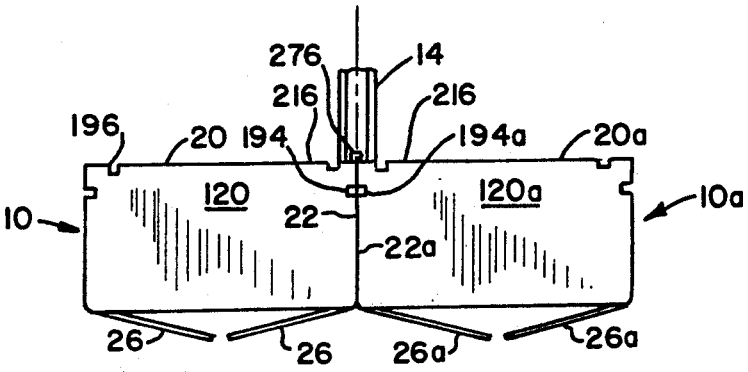
FIG. 15 is a schematic plan view of a second arrangement of a pair of cabinets in side-to-side relationship and connected to a freestanding wall.
Figure 16A:
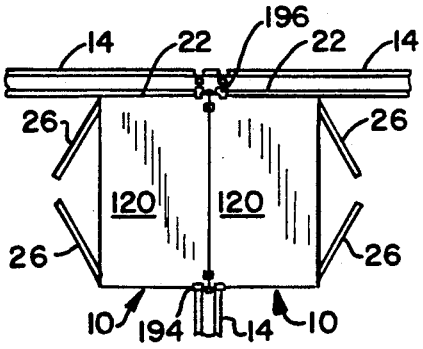
FIGS. 16(*a*) through 16(*n*) are schematic plan views of other arrangements that can be made between one or more cabinets and freestanding walls.
Figure 16B:
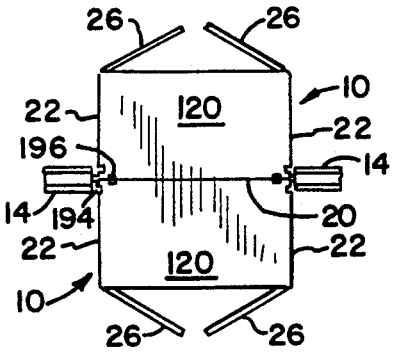
Figure 16C:
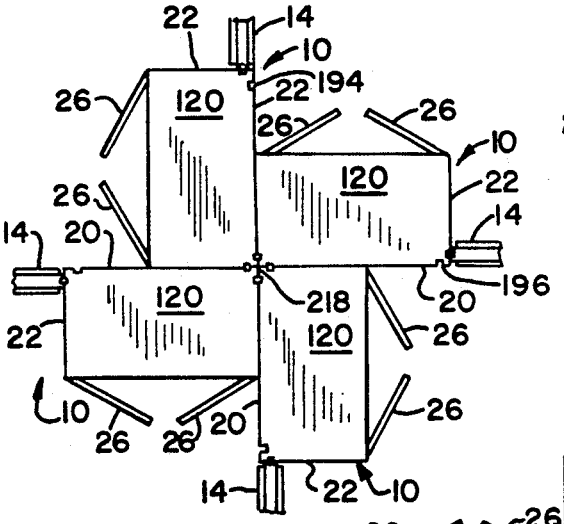
Figure 16D:
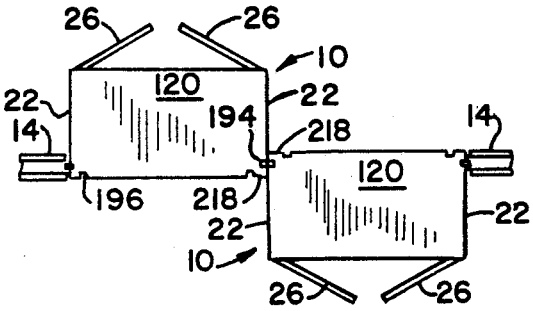
Figure 16E:
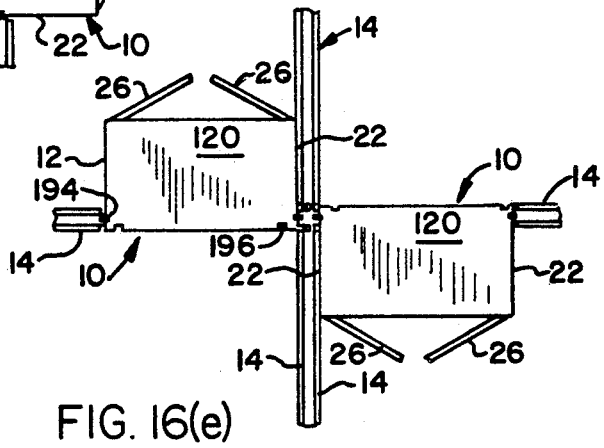
Figure 16F:
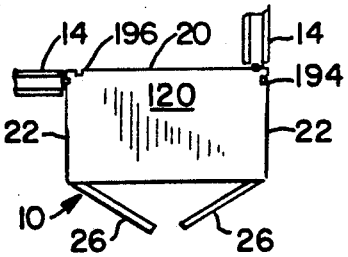
Figure 16G:
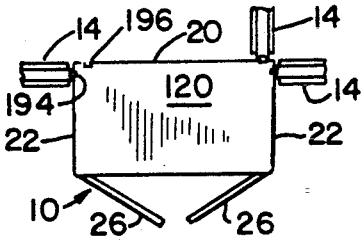
Figure 16H:
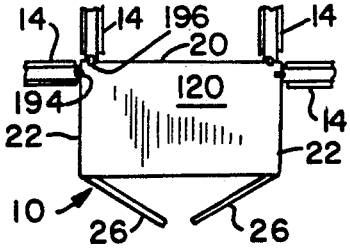
Figure 16I:
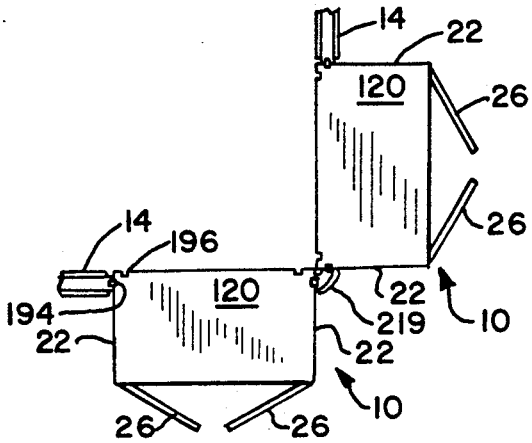
Figure 16J:
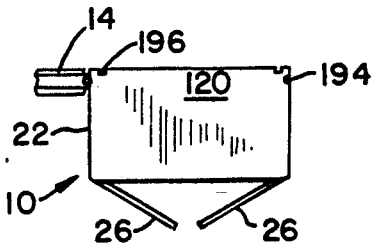
Figure 16K:
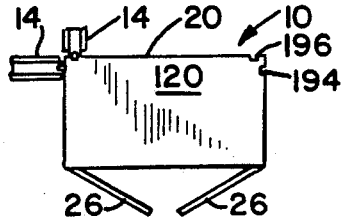
Figure 16L:
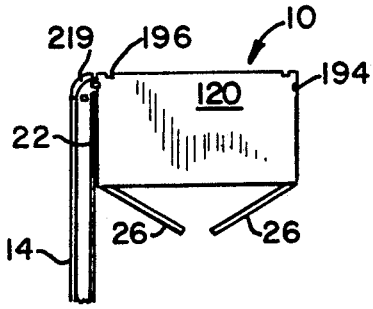
Figure 16M:
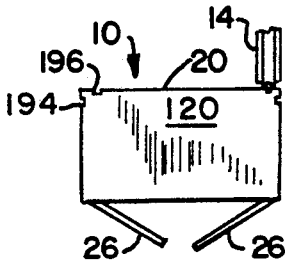
Figure 16N:
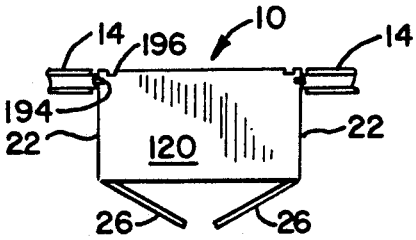

Referring to FIGS. 14, 15, and 16(*a*)–16(*c*), in addition to connecting to a wall, a plurality of cabinets 10, 10*a* may be placed so their back walls 20, 20*a*, side walls 22, 22*a* or a combination of back walls and side walls are in an abutting position. Cabinets may also be placed in a perpendicular orientation, interfacing only at a rear corner 218 of each cabinet. This capability allows cabinets to be simultaneously connected to other cabinets and a wall. These arrangements facilitate placement of cabinets 10 to suit a variety of work environments and workstations. For example, the four-corner connection arrangement in FIG. 16(*c*) could be used where there are four modular work spaces in which it is desired that each work space be equipped with a storage cabinet 10. As illustrated in FIGS. 16(*i*) and 16(*l*), a conventional wall corner piece 219 disclosed in the above-referenced U.S. Pat. No. 4,571,907 to DeFouw et al. may be necessary to connect the cabinet 10 to a wall panel 14 or a second cabinet.

Figure 18:
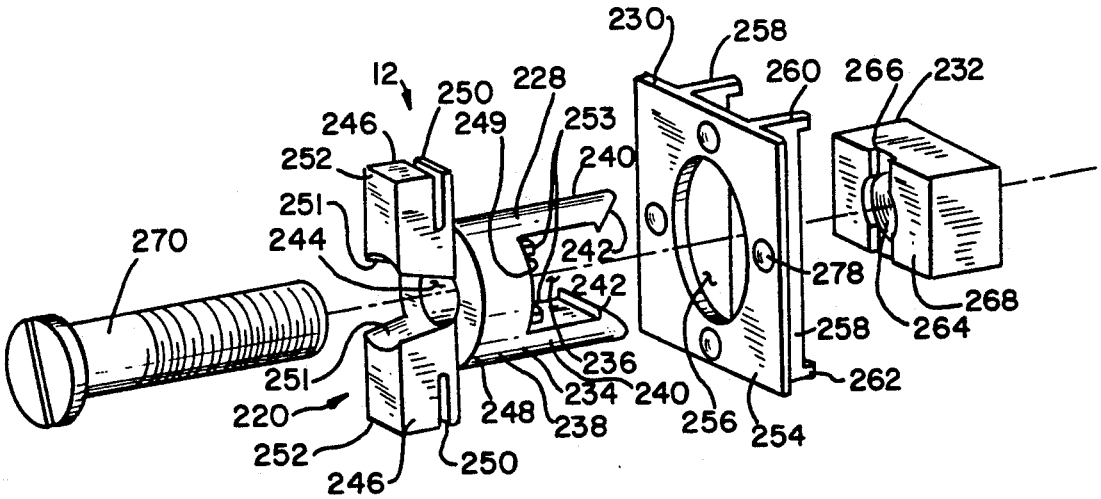
FIG. 18 is a perspective exploded view of an in-line connector used to connect a cabinet to a free-standing wall.
Figure 19:
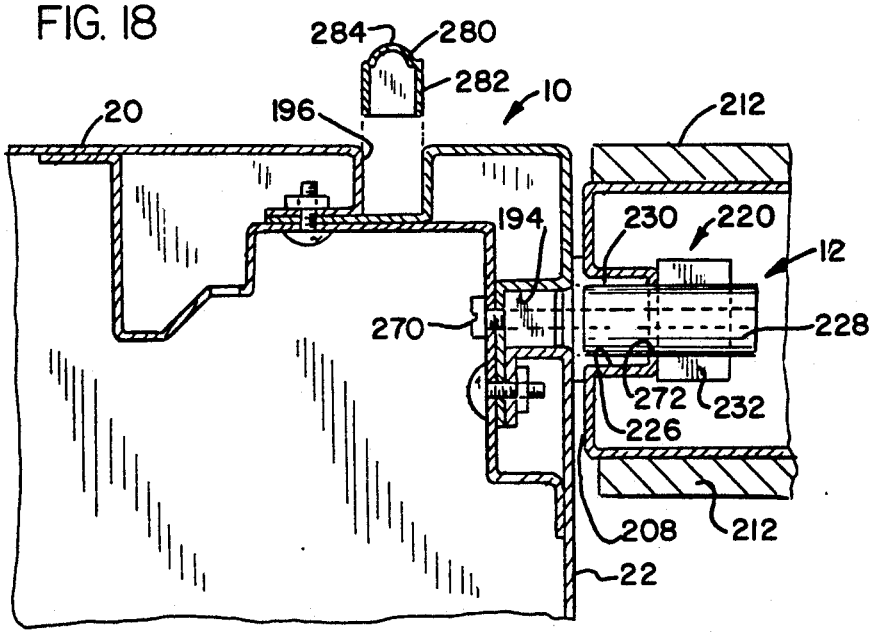
FIG. 19 is a plan view in section showing the cabinet and a freestanding wall attached in the configuration of FIG. 12 by an the in-line connector of FIG. 18.
Figure 20:
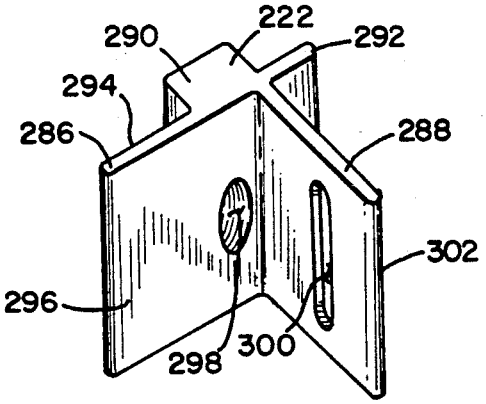
FIG. 20 is a perspective view of a face connector.
Figure 22:
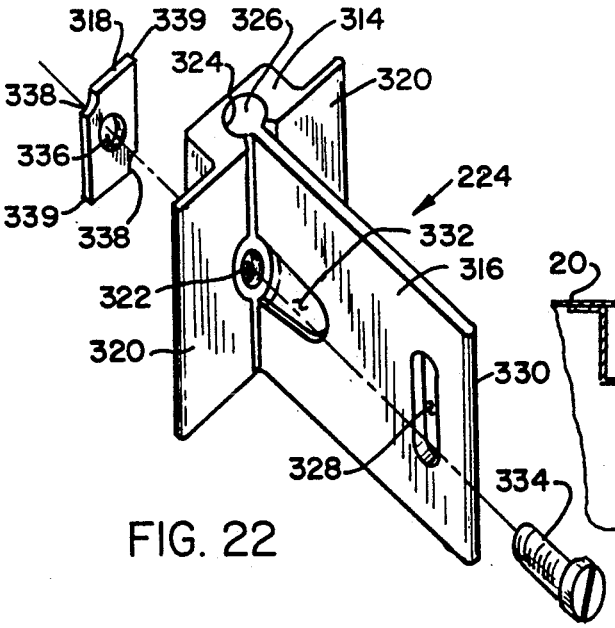
FIG. 22 is a perspective exploded view of a centerline connector.
Figure 23:
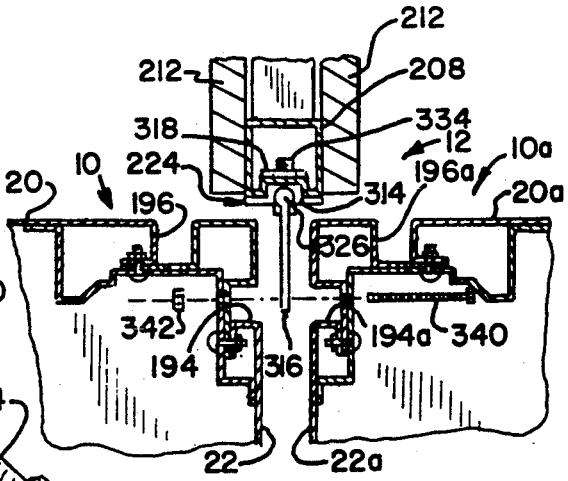
FIG. 23 is an exploded plan view in section of a portion of cabinets and freestanding wall shown in FIG. 15 and illustrating the mounting of the centerline connector of FIG. 22 to the cabinets and the wall.

As seen in FIGS. 18–24, a variety of connectors 220, 222, 224, 226 are provided for attaching a cabinet 10 in a particular functional arrangement with the wall 14 or other cabinets 10*a*. An in-line connector 220 shown in FIGS. 18 and 19 mounts a cabinet to a wall wherein the cabinet is either interposed between two walls 14 connecting to the cabinet side wall, or a wall 14 connecting to the cabinet back wall. A face connector 222 illustrated in FIGS. 20 and 21, is used to mount the cabinet to a wall 14 extending parallel to the cabinet back wall 20. A centerline connector 224, seen in FIGS. 22 and 23, is used to connect two cabinets to a wall 14. If the cabinets are placed back to back, the centerline connector attaches to cabinet adjacent side walls 22, 22*a*. If the cabinets are placed side to side, the centerline connector attaches to the cabinet back walls 20, 20*a* at adjacent cabinet back wall channels 196, 196*a*. Finally, a back-to-back connector 226, illustrated in FIGS. 24 and 25, attaches two cabinets in either a back-to-back or side-to-side arrangement. A multipurpose connector 223 illustrated in FIGS. 25(*a*)–25(*c*) can be used to replace the face connector 222 or back-to-back connector 226. The connection means 12 are removably mounted to a wall channel 194 or 196 and either a freestanding wall vertical frame member 208 or a wall channel 194*a* or 196*a* of a second cabinet 10*a*.

Figure 11:
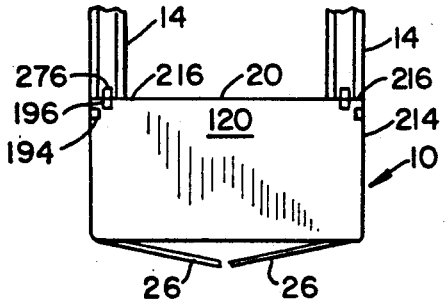
FIG. 11 is a schematic plan view of the cabinet showing a first arrangement of connection between the cabinet and freestanding walls.
Figure 12:
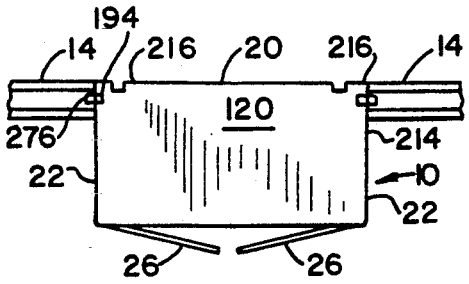
FIG. 12 is a schematic plan view of the cabinet showing a second arrangement of connection between the cabinet and freestanding walls.

FIGS. 18–19 show the in-line connector 220 that is used for mounting the cabinet to a freestanding wall in the configurations representatively shown in FIGS. 11–12. Specifically, the in-line connector mounts a cabinet end-on to the wall 14. The connector 220 comprises a retainer 228, a collar 230, a block 232 and a bolt 270.

The retainer 228 comprises an annular portion 234 having a slot 236 extending laterally from a base 238 of the annular portion to form a pair of spaced bilateral legs 240, lower ends of which are tapered and include step portions 242. The annular portion further includes a longitudinally extending bore 244 aligned with the slot 236. The annular portion 234 is preferably made of injection molded plastic (such as nylon). In addition, the retainer 228 has two bilateral arms 246 on a first face 248 of the annular portion on opposite sides of the bore 244 and aligned with the legs 240. The arms 246 are generally rectangular in shape and have a slot 250 extending inwardly from an outside edge 252 of each arm 246. The inner surface 251 of the arms can be tapered to guide a bolt 270 which is used to attach the connector as described below.

The collar 230 comprises a rectangular plate 254 having a central hole 256 with a diameter slightly greater than that of the retainer annular portion 234, and a pair of parallel spaced flange portions 258 extending inwardly from the plate 254. Each flange 258 has a slot 260 extending along a longitudinal edge 262. The collar 230 is preferably made of injection molded plastic (such as nylon).

The block 232 is rectangular in shape and has extending therethrough a partially threaded central hole 264 of a predetermined diameter. A substantially rectangular channel 266 is formed in and along a central transverse axis of an outer face 268 of the block and is in registry with a hole 264. The block is preferably made of metal.

In mounting the cabinet 10 to the freestanding wall 14 in the arrangements using the in-line connector 220, the connector is first secured to the wall 14. The cabinet is then secured to the connector through either the cabinet back or side wall channels 196, 194, respectively.

The installation of the in-line connector is best seen in FIG. 19. To install the connector 220, the collar 230 is placed over the annular portion 234. The block 232 is positioned within the legs 240 and is held in place between the legs 240, the annular portion 234 and the step portions 242 by a snap fit means. Specifically, a pair of generally rectangular protrusions 253 on a second annular face 249 engage the channel 266 in block 232 to retain the block to the retainer 228. The block 232 is rotated so its longitudinal axis is in a vertical orientation and can be inserted into a rectangular hole 272 located on the edge 274 of the freestanding wall vertical frame member 208. The collar flanges 258 are positioned so they are within a vertical channel 276 extending along the vertical frame member edge 274. The block 232 is rotated ninety degrees by rotating the retainer arms 246 so the block longitudinal axis lies in a horizontal plane.

As the arms 246 are rotated, protrusions thereon (not shown) pass over indentations 278 on the collar 230. The arm slots 250 permit the arms 246 to provide a leaf spring action as they ride over the indentations 278. This action serves as a locking function, securing the block 232 in a horizontal orientation.

As illustrated in FIG. 19, after the arms 246 are rotated, they are in a vertical orientation, thereby allowing the arms to be positioned within the cabinet wall channel. The bolt 270 is then inserted from the inside of the cabinet, through the retainer 228 and into the block 234 to secure the cabinet to the freestanding wall. Although FIG. 19 illustrates the use of the connector 220 to attach a cabinet side wall 22 to a wall 14, the connector can also be used to attach a cabinet back wall 20 to a vertical frame member 208 of a free-standing wall 14. A plurality of in-line connectors 220 can be attached to securely fasten the cabinet 10 to the wall panel 14.

A generally U-shaped plastic channel cover 280 can be inserted into unused cabinet wall channels. 194, 196. Side portions 282 of the channel cover 280 are dimensioned so they provide a compression fit into the unused cabinet wall channels. A channel cover web portion 284 is radiused outwardly from the cabinet walls 20 or 22.

FIGS. 20–21 illustrate the face connector 222 and the use thereof to mount the cabinet 10 to the freestanding wall panel 14. Specifically, the face connector is used when the cabinet back wall 20 is placed parallel to the wall 14 as representatively seen in FIG. 13. In this configuration, the cabinet back wall replaces wall tiles 212 on the side of the freestanding wall that interfaces the cabinet. A plurality of face connectors 222 can be used to securely join the cabinet 10 to the wall frame vertical member 208. Each connector 222 comprises first and second rectangular plate portions 286, 288 integrally formed and positioned perpendicular to each other, and a lug 290. The second rectangular portion 288 is placed a predetermined distance from an edge 292 of the first rectangular plate portion 286. The lug 290 is also positioned a predetermined distance from the edge 292, but is on a face 294 opposite the face 296 used by the second plate portion 288. A threaded bore 298 extends through the first plate portion 286 and the lug 290. An elongated slot 300 extends along the second plate portion 288 at a predetermined distance from an outer edge 302 of the second plate. The face connector is preferably made of metal.

Figure 13:
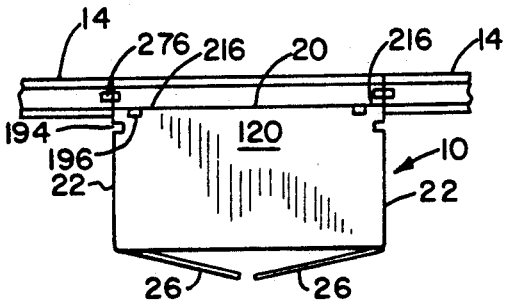
FIG. 13 is a schematic plan view of the cabinet showing a third arrangement of connection between the cabinet and freestanding walls.

The application of the face connector 222 will now be described. Referring to FIGS. 13 and 21, there is seen the cabinet 10 mounted to the face 304 of a wall frame 206. To install the cabinet 10, the freestanding wall tiles 212 are removed from the wall frame 206. A face connector 222 is mounted to inside edges 306 of each frame vertical member 208 at both upper and lower locations of the vertical member. Specifically, connectors 222 are fastened as by screws 308 to the vertical members 208 by screws in registry with aligned holes in the connector and the vertical member. Typically, four connectors are used to secure the cabinet to the frame 206. After the connectors 222 are attached to the wall frame vertical member, the cabinet 10 is placed adjacent wall frame 206, aligning each connector lug 290 so they register with the cabinet back wall channels 196. Screws 310 can then be inserted through the channel aligned openings 154, 184, and into each connector threaded bore 298, thereby securing the cabinet 10 to the wall frame 206. The panel tiles 212 are then replaced on the panel side 312 opposite the side 304 interfacing the cabinet 10. In this configuration, the plinth 16 recess can accommodate the wall baseline cover 78, as seen in FIG. 7.

A centerline connector 224, illustrated in FIGS. 22–23, is used for the configurations representatively shown in FIGS. 14 and 15. In FIG. 14, the back walls 20, 20*a*, of cabinets 10, 10*a* abut each other. The freestanding wall 14 extends to and terminates at the interface of the abutment. In FIG. 15, side walls 22, 22*a* of each cabinet 10, 10*a* abut each other. The freestanding wall 14 extends to and terminates at the interface of the abutment. A plurality of connectors 224 can be used in vertically spaced relationship to securely attach the cabinets together and to connect the cabinets to the terminal end of the freestanding wall 14.

Referring to FIGS. 22–23, the centerline connector is generally T-shaped, comprising a central retainer portion 314, a rectangular blade portion 316 rotatably attached by a hinge 326 to the central retainer portion, and a rectangular-shaped block 318. The central portion 314 is rectangular in cross section and has bilateral flanges 320 extending along the length of the central portion. A bore 322, oriented perpendicularly to the longitudinal axis, is positioned at the center of the central portion. A trough 324 extends longitudinally along the central portion to facilitate a hinge 326.

The hinge 326 pivotally connects the blade portion 316 to the central portion 314. The rectangular blade portion 316 extends outwardly from the hinge location in a direction away from the central portion 314. An elongated hole 328 is located at a predetermined distance from an outer edge 330 of the blade portion 316. An elongated slot 332 located on the blade portion 316 extends inwardly into the same and is in alignment with the bore 322 in the central portion 314. A bolt 334 extends through the bore 322 and into the block 318, the latter having a threaded hole 336 through its center. Scalloped corners 338 on the block engage pins (not shown) extending from the central portion 314 to orient the block vertically when the bolt is loosened. This facilitates removal of the connector 224 from the wall panel vertical frame member 208. During installation, rotation of the bolt 334 causes the block 318 to rotate until non-scalloped corners 339 of the block 318 abut the block pins (not shown). By this abutment, the block is oriented so it cannot be withdrawn from the vertical frame member 208 after the connector is installed as described below. To assure that the block 318 will properly rotate with the bolt 334, the outermost or innermost thread of the threaded hole 336 may be deformed slightly. However, the amount of deformation must be limited so the bolt 334 can continue to be tightened or loosened after the block 318 engages the central portion pins (not shown). The centerline connector 224 is preferably made of a metal such as aluminum.

The operation of the centerline connector 224 will now be described. The blade portion 316 is rotated so it is adjacent one of the flange portions 320. The connector 224 is secured to the freestanding wall vertical frame member 208 with the bolt 334 and block 318 in a manner similar to that of the in-line connector 220 as described above. Specifically, the bolt 334 is inserted through the bore 322 and threaded into block 318. With the block oriented with its longitudinal axis extending vertically, the centerline connector central portion 314 is inserted into the freestanding wall vertical frame member channel 276 so the block 318 extends through the channel hold 272. The bolt 334 is tightened, thereby rotating the block ninety degrees so the non-scalloped corners 339 engage the central portion pins (not shown). In this position, the block 318 cannot be withdrawn from the channel hole 272. The centerline connector 224 is thereby fastened to the wall vertical frame member 208.

The next step in attaching the centerline connector 224 is to place two adjacent cabinets 10 and 10*a* so their back walls 20, 20*a* or side walls 22, 22*a* can be secured together. FIGS. 14 and 23 illustrate the use of the connector 224 to attach adjacent side walls 22, 22*a* together. However, the procedure is identical for connecting adjacent back walls 20, 20*a* as illustrated in FIG. 15. As seen in FIGS. 14 and 23, the two cabinets 10, 10*a* are placed so the side wall channels 194, 194*a* are aligned and having the blade portion 316 of the connector 224 positioned between the side walls so the slot 328 aligns with channel openings 150 and 150*a* and flange openings 186 and 186*a*. A bolt 340 is inserted through aligned cabinet openings 150, 186, 150*a*, 186*a* and slot 328 and secured with nut 342. A plurality of centerline connectors 224 can be used in vertical relationship to securely fasten the cabinets 10 and 10*a* and the freestanding wall 14 together.

Disassembly of the centerline connector 224 is carried out by reversing the above-described steps. When the bolt 334 is loosened, the block 318 rotates so the scalloped corners 338 engage the central portion pins (not shown). In this position the block 318 is oriented vertically, thereby enabling the connector 224 to be withdrawn from the vertical frame member 208.

Figure 24:
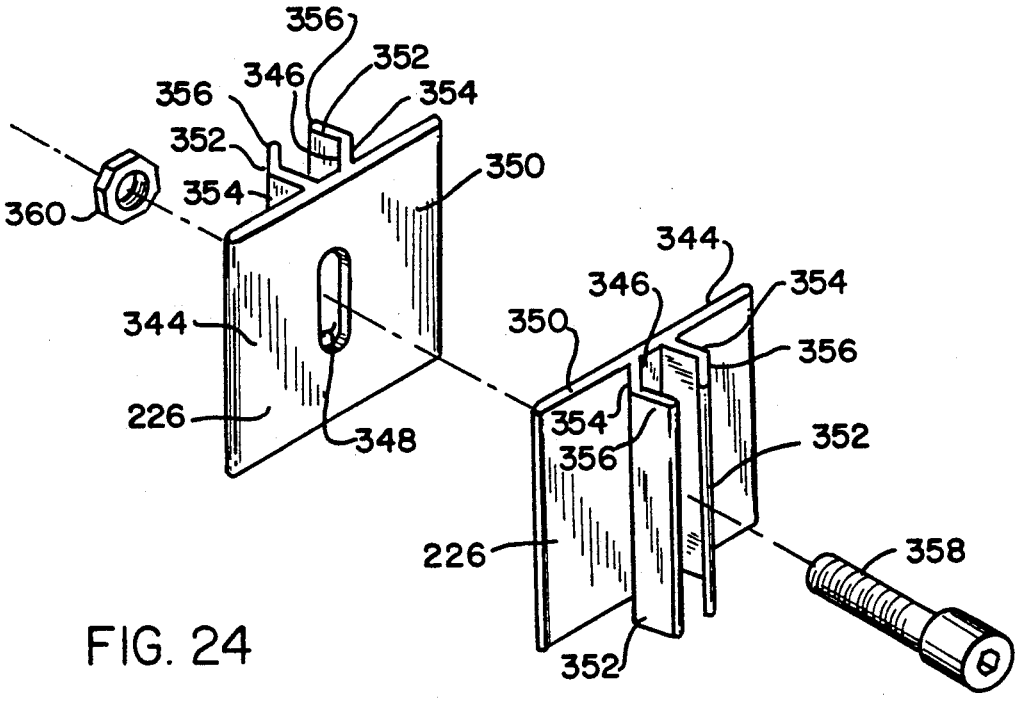
FIG. 24 is a perspective exploded view of a pair of back-to-back connectors used to join the cabinets together in a back-to-back or side-to-side relationship.
Figure 25:
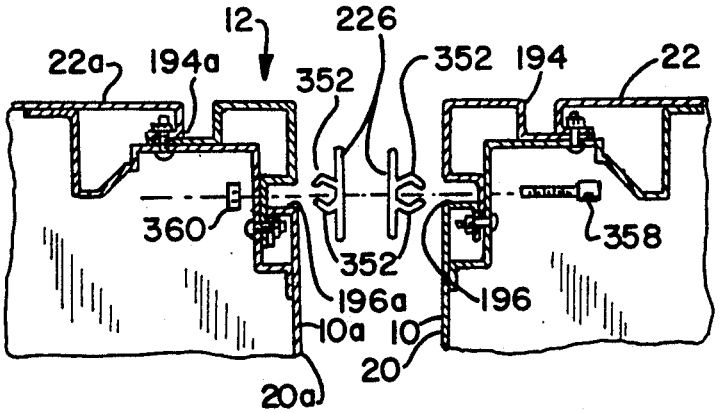
FIG. 25 is an exploded plan view in section of portions of a pair of cabinets and the back-to-back connectors shown in FIG. 24 illustrating the manner in which the portions of the back walls opposite the wall shown in FIG. 14 can be joined by the back-to-back connector.
Figure 26:
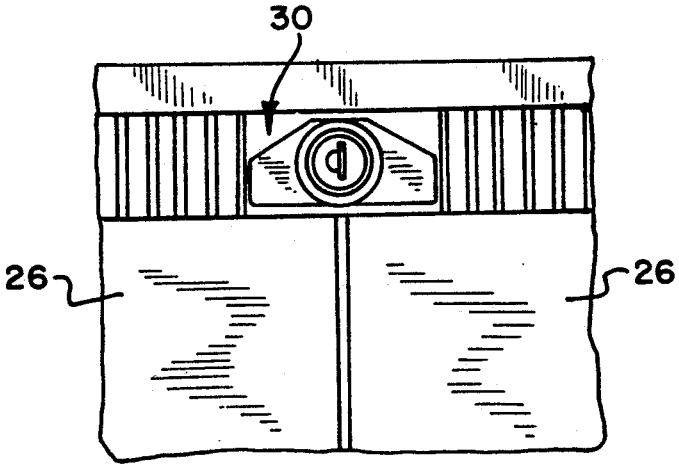
FIG. 26 is an enlarged partial front elevational view of the cabinet of FIG. 2 showing a locking means.
Figure 25A:
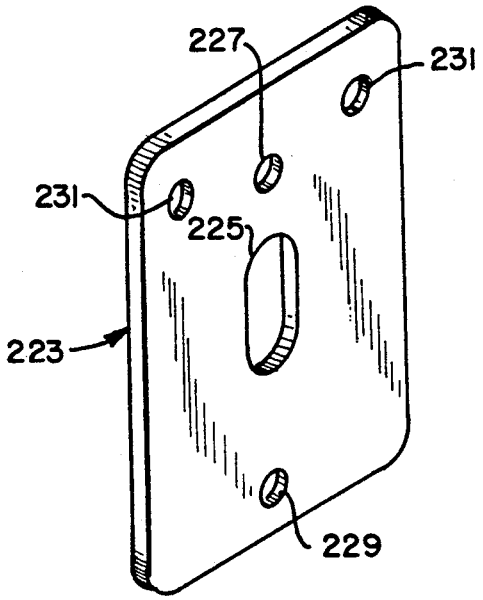
Figure 25B:
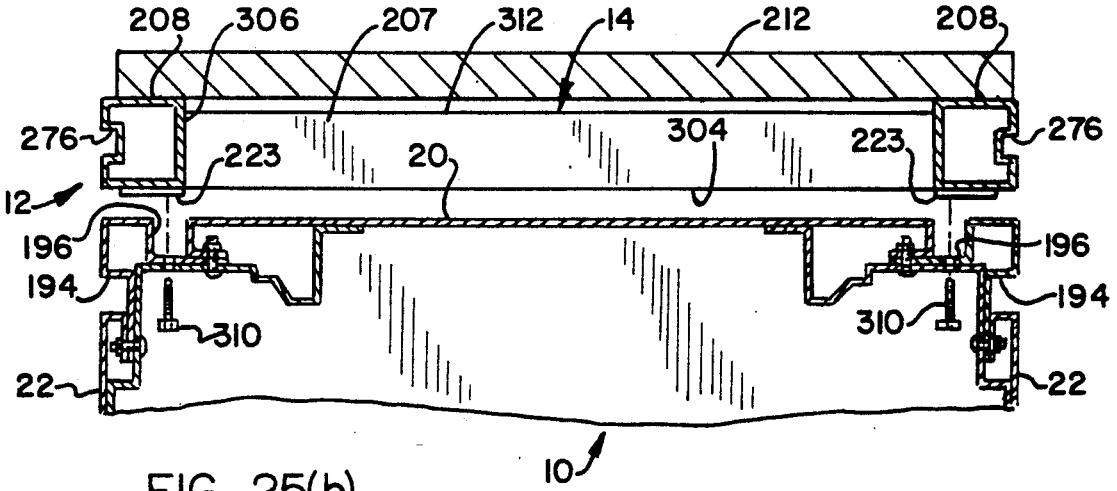
Figure 25C:
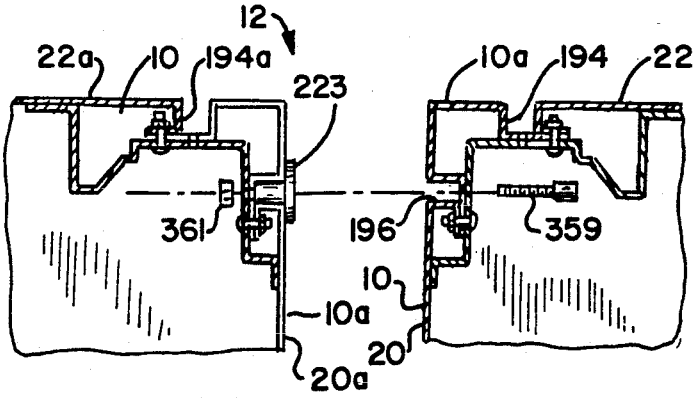

The back-to-back connector 226 seen in FIG. 24–25 is used to connect two adjacent cabinets 10 and 10*a* together without requiring the cabinets to be mounted to a freestanding wall panel as representatively illustrated in FIG. 16(*d*). It can also be used if the cabinets are in a back-to-back arrangement having only one wall 14 connected to the cabinet pair, as seen in FIG. 14. Specifically, the connector 226 is used at the pair of back wall channels on the opposite side of the cabinets from the freestanding wall. The cabinets may be attached in a back-to-back or a side-to-side orientation with the connector 226. The back-to-back connector comprises a rectangular portion 344 and resilient arms 352 forming a channel 346. The rectangular portion 344 has a vertically oriented elongated hole 348 in the center portion 350 and aligned with the channel 346. The resilient arms 352 have an outwardly canted portion 354 and an inwardly canted portion 356. The resilient arms 352 are dimensioned so the connector 226 fits snugly by a compression fit in the cabinet channels 194 or 196. The resilient arms 352 function to hold the connector 226 in place during attachment of the cabinets 10 and 10*a*. The back-to-back connector is preferably made of a plastic material and functions to prevent adjacent walls of the cabinets from scraping against each other. Specifically, the rectangular portion 344 spaces the adjacent cabinet walls 20 and 20*a*, or 22 and 22*a* apart.

The operation of the back-to-back connector 226 will now be described. In the back-to-back arrangement, connectors 226, 226*a* are placed in adjacent back wall channels 196, 196*a* on each cabinet 10, 10*a*. In the side-to-side arrangement, connectors 226, 226*a* are placed in adjacent side wall channels 194, 194*a* on each cabinet 10, 10*a*. As shown in FIGS. 24 and 25, adjacent connectors 226, 226*a* form a pair. For each pair of connectors, a bolt 358 is inserted from the inside of the first cabinet 10, through aligned channel openings 150, 186 or 154, 184, through hole 348 in each connector 226, 226*a* and into the second cabinet 10*a* through aligned channel openings 150*a*, 186*a* or 154*a*, 184*a*. The bolt 358 is threaded onto a nut 360, thereby securing the cabinets 10 and 10*a* together. A plurality of back-to-back connectors 226 can be used to securely fasten the cabinet 10 and 10*a* together. Although FIG. 25 illustrates the use of connector 226 for use with adjacent back walls 20, 20*a*, the installation procedure is identical for connecting adjacent cabinet side walls 22, 22*a*.

Referring to FIG. 25(*a*), the multipurpose connector 223 provides an alternate connection means for the face connector 222 or back-to-back connector 226. The connector 223 comprises a generally rectangular shaped elastomeric pad having a central elongated hole 225 and a pair of circular apertures 227, 229 set in coaxial relationship to the longitudinal axis of hole 225. The apertures 227, 229 are positioned near opposite sides of hole 225 at a predetermined location. A pair of colinear openings 231 are positioned on opposite sides of aperture 227 at predetermined locations and positioned so a line extending between the centers of openings 231 is perpendicular to the longitudinal axis of the elongated hole 225. One face of the elastomeric pad connector 223 has attache thereon a layer of adhesive.

To mount the multipurpose connector 223 as a face connector, the connector 223 is positioned on the wall panel vertical frame member 208 so the apertures 227, 229 align with vertical frame member holes 215 and so the aperture 227 is located above aperture 229. The adhesive serves to hold the connector in place.

A pilot hole (not shown) is drilled through the vertical frame member 208 by using the opening 231 that is on the inside relative to the wall panel frame 206 as a guide.

As illustrated in FIG. 25(*b*), after the cabinet 10 is positioned adjacent to the wall panel frame, a self-tapping screw 233 is inserted from inside the cabinet through the pilot hole to fasten the cabinet to the wall frame. A plurality of connectors 223 may be attached to both vertical frame members 208 to securely fasten the cabinet 10 to the frame 206.

In addition to functioning as a connector means, connector 223 operates to space the cabinet 10 from the wall panel frame 206 to avoid any scraping damage to the cabinet back wall 20.

As seen in FIG. 25(*c*), the multipurpose connector 223 also functions as a substitute for the back-to-back connector 226. Specifically, the connector 223 is mounted over the side wall channel 194 or back wall channel 196 of a first cabinet 10 with the adhesive covered connector face holding the connector to the cabinet. The connector is positioned so the elongated hole 225 aligns with the applicable channel aligned openings 150, 186 or 154, 184. After a second cabinet 10*a* is placed adjacent to the first cabinet, a bolt 359 is inserted through the aligned channel openings of the first cabinet 10, through connector hole 225, and through the aligned openings of the second cabinet 10*a* and secured by a nut 361.

In addition to securing the cabinets together, the connector 223 operates to space the cabinets apart, thereby preventing any scraping damage to the interfacing cabinet walls. A plurality of multipurpose connectors 223 may be used in each set of aligned cabinet side wall channels 194, 194*a* or back wall channels to securely fasten the cabinets together.

Another alternative embodiment (not shown) for the face connector 222 and back-to-back connector 226 comprises a layer of tape having adhesive on one face. The tape has a thickness of approximately ⅛ inch and a width of approximately ½ inch. As a means of replacing the face connector 222, a strip of tape is placed vertically along the cabinet back wall 20 near each outer end thereof. The cabinet can then be secured to the wall panel vertical frame members 208 by using the cabinet channel openings as a guide to drill holes in the frame member 208. Self-tapping screws are then inserted through the channel openings and the wall frame holes to secure the cabinet to the wall frame. The tape functions to space the cabinet 10 from the wall frame 206.

According to this alternative embodiment, the back-to-back connector 226 can be replaced by placing a layer of tape on the cabinet so it extends vertically near the outer ends of one of the interfacing cabinet walls. The cabinets are then placed adjacent to each other. The adhesive serves to space the cabinets apart so they are not subject to scraping damage. The cabinets are secured together by installing bolts 358 and nuts 360 as described above for the back-to-back connector 226.

The front doors 26 are mounted to the cabinet front vertical frame members 122. The doors are rectangular in shape, having handles 362 located on inner door edges 364. A conventional hinge means (not shown) is used to rotatably mount the doors to the front vertical frame members. The doors are preferably made of a sheet metal or a wood laminated door having either a honeycombed or a solid core construction.

The cabinet interior 24 serves as an enclosed storage area and is adaptable to a variety of storage needs. The vertically spaced holes 158 in the rear vertical frame members 124 mount brackets to enable items such as shelving to be placed in the cabinet 10.

Figure 27:
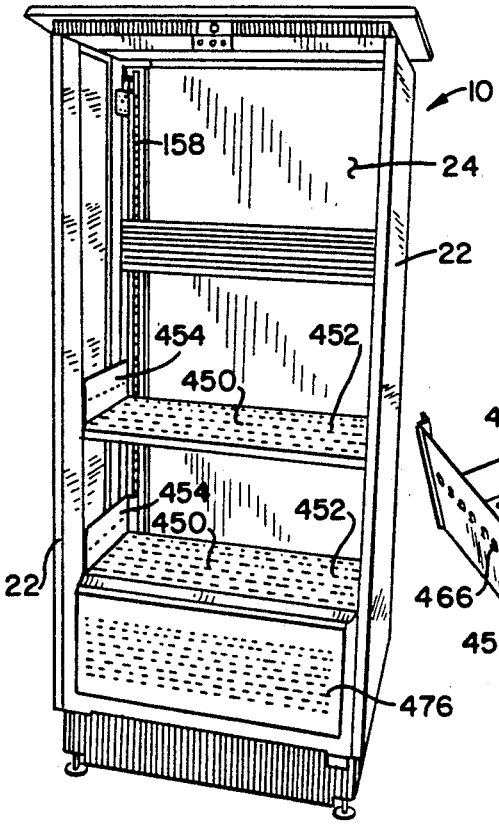
FIG. 27 is a perspective view of the cabinet of FIG. 2 with the doors removed and showing the interior of the cabinet a first shelving arrangement.
Figure 29:
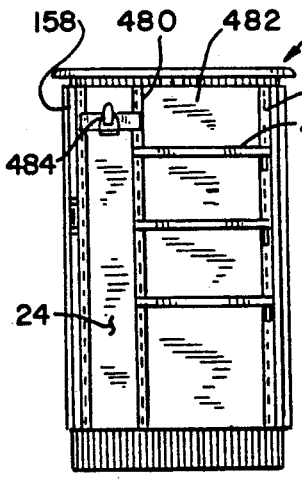
FIG. 29 is a front elevational view of the cabinet of FIG. 2 showing a second shelving arrangement.

Adjustable shelving adaptable to insertion on the cabinet back wall 20 is illustrated in FIGS. 27 and 29. A shelf 450 comprises a base portion 452, two side walls 454, and a plurality of downwardly depending hooks 458 on an inner edge 460 of each shelf side wall 454. The shelf may further comprise a rear wall 456. The holes 158 serve as mating slots for the shelf hooks 458. By this hook and slot means, the shelves 450 can be hung along the cabinet back wall 20. An uppermost shelf hook 462 is larger than the remaining hooks 458 and has a protruding portion 464. This feature facilitates the ease of inserting the shelf 450 into the holes 158. The protruding portion 464 engages the sloping portion 160 of the rear vertical from member 124 to guide the uppermost hook 462 into its mating hole 158. The remaining hooks 458 can then be easily inserted into their mating holes 158. FIG. 27 also illustrates the use of optional pocketing means 532 to pocket the doors 26 within the cabinet 10.

Figure 28:
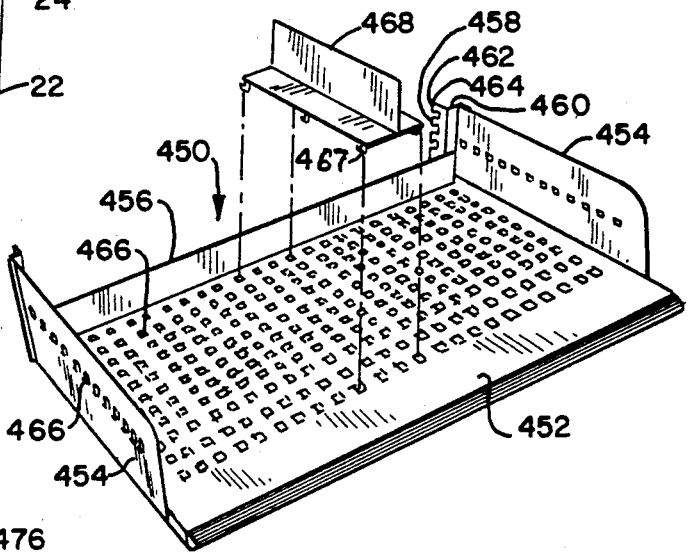
FIG. 28 is a perspective view of shelving which is mountable into the interior of the cabinet shown in FIG. 30.

As seen in FIGS. 27 and 28, a plurality of rows of square holes 466 located on the shelf base 452 and side walls 454 engage with downwardly depending hooks 467 on accessories such as a bookend 468 to hold the accessories in place on the shelf 450. The shelves 450 may be fitted with tracks (not shown) on the shelf bottom surface to slidably mount wireform storage bins (not shown) to the shelf bottom surface.

In an embodiment seen in FIG. 27, a drawer 476 is slidably mounted on a pair of conventional drawer slides (not shown) mounted on the cabinet vertical frame members 122, 124. The drawer 476 is used to hang file folders or stores articles.

As illustrated in FIG. 29, by adding an additional slotted rail 480 in the central portion 482 of the back wall 20, shelving 450 extending only partially across the width of the cabinet 10 may be installed. This configuration facilitates storage of long objects such as a broom as well as placement of hanging storage bins 484.

Figure 30:
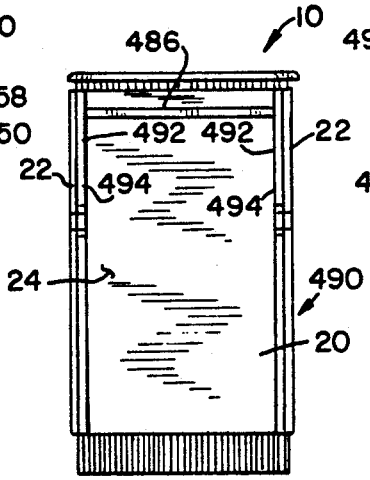
FIG. 30 is a front elevational view of the cabinet of FIG. 2 showing a wardrobe embodiment.
Figure 31:
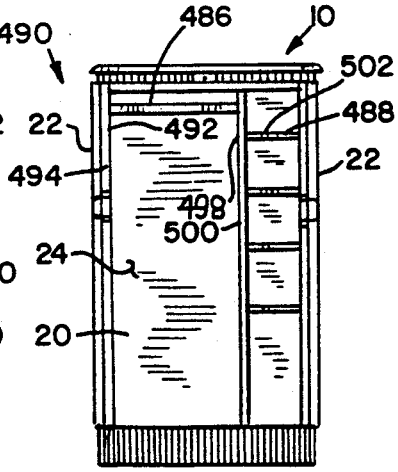
FIG. 31 is a front elevational view of the cabinet of FIG. 2 showing a combination wardrobe and shelving embodiment.

Embodiments displayed in FIGS. 30 and 31 reveal hanging rods 486 and fixed shelving 488 securely fastened as by a bolt (not shown) to the interior portion 24 of the cabinet 10. A wardrobe cabinet embodiment 490, shown in FIG. 33, has a hanging rod 486 attached to the upper portions 492 of the cabinet side wall inner faces 494 by means of conventional fasteners (not shown).

A variation of the wardrobe embodiment has a hanging rod 486 and fixed shelving 488 as shown in FIG. 31. In this embodiment, the hanging rod 486 is attached by any suitable mechanical means to and between a cabinet side wall 22 and an upper portion 498 of a shelving side wall 500. The shelving is comprised of the side wall 500, and vertically spaced shelves 502. The cabinet side wall 22 not attached to the rod 486 functions as the second side wall for the shelving 488.

Figure 32:
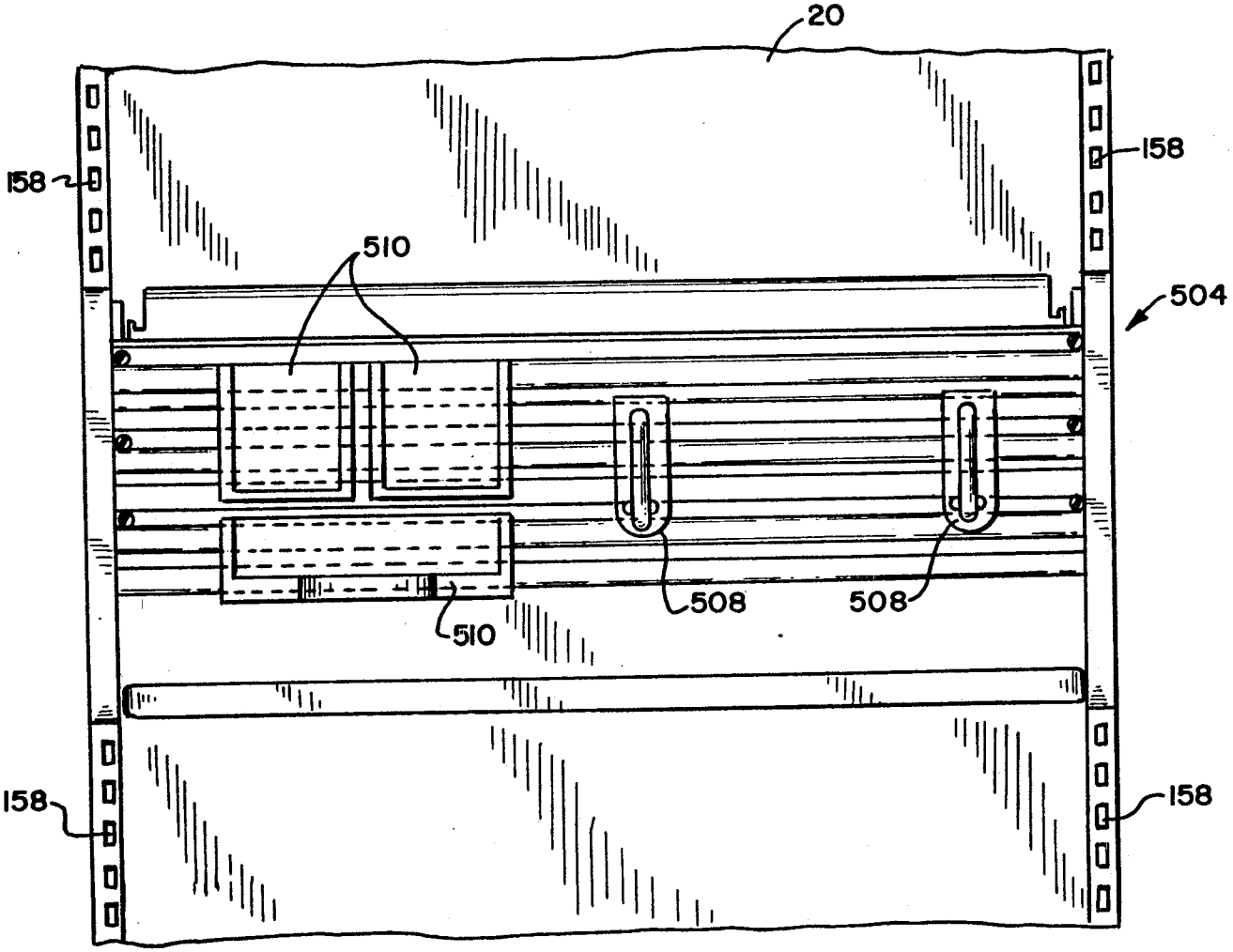
FIG. 32 is an enlarged partial front elevational view of the interior of the cabinet of FIG. 2 having a hanger rail.

The cabinet interior 24 can include hanger rails 504 fitted onto the cabinet back wall 20 as illustrated in FIG. 32. The hanger rail 504 is similar to that disclosed in the U.S. Pat. No. 4,618,192 to Kelley issued Oct. 21, 1986. The rails 504 comprise hooks (not shown) which are inserted into the vertical frame member holes 158. Articles such as hanging hooks 508 or bins 510 can be hung from the hanger rail 504.

Figure 33A:
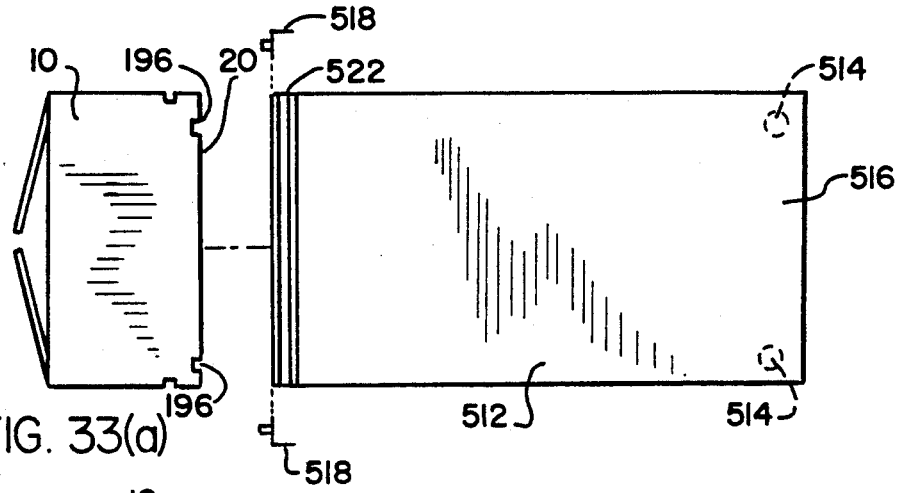
FIG. 33(*a*)-33(*c*) are plan views of the cabinet of FIG. 2 having a work surface mounted to a back wall thereto and a pair of cabinets having a work surface mounted to back walls or side walls thereto.
Figure 33B:
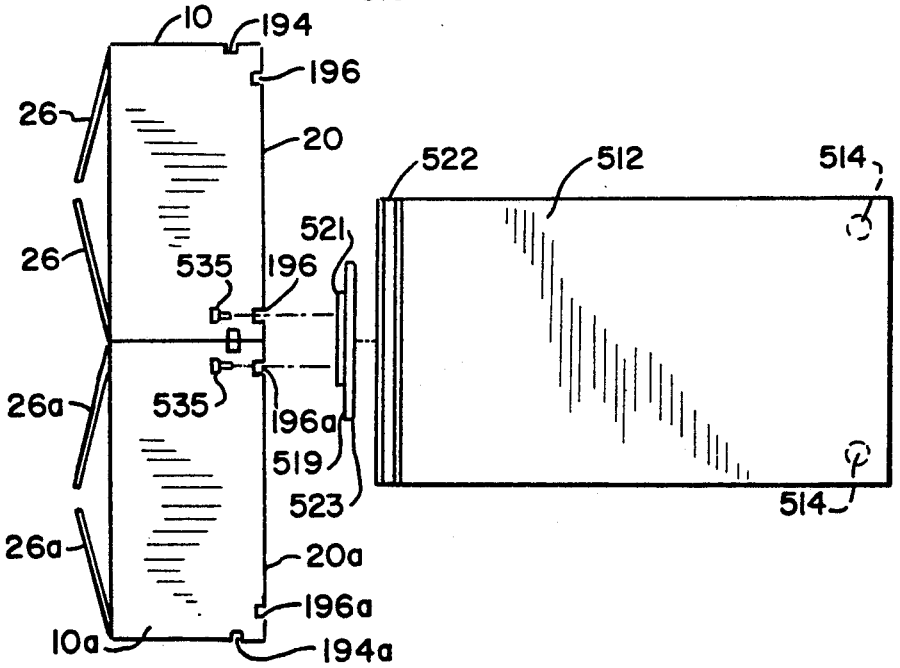
Figure 33C:
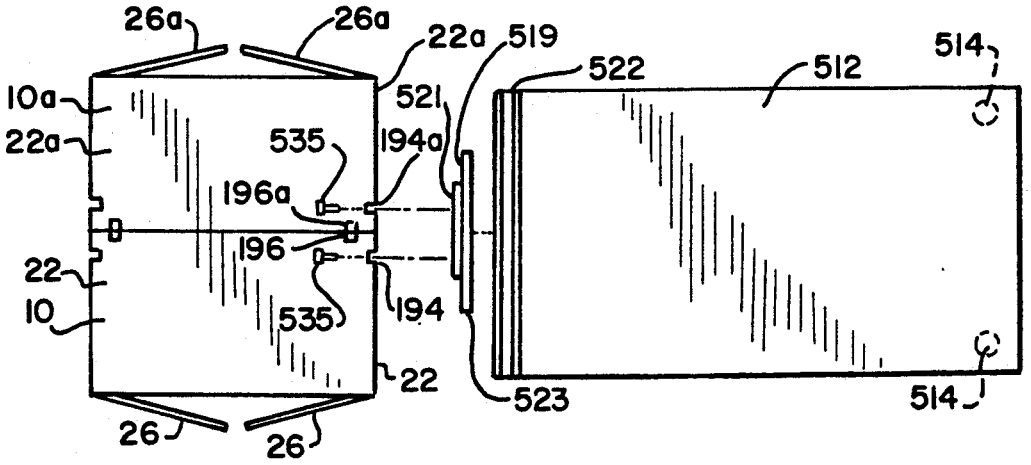
Figure 34:
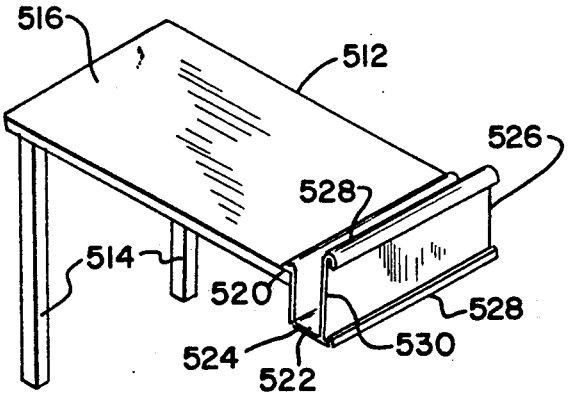
FIG. 34 is a perspective view of the work surface assembly of FIG. 33.

An optional work surface 512, preferably made of a wood veneer or laminate construction, removably attaches to the cabinet 10 as illustrated in FIGS. 33 to 36. Specifically, the work surface can be mounted to the back wall channels 196 of a cabinet 10 as illustrated in FIG. 33(*a*), or to adjacent back wall channels or side wall channels for a pair of cabinets 10, 10*a* in a back-to-back or side-to-side configuration, respectively, as illustrated in FIGS. 33(*b*) and (*c*). An example work surface 5!2 is rectangular in shape and is supported on the floor by two legs 514 mounted to an outer end 516 of the work surface. The work surface 512 has securely mounted to and extending along the inner edge 520 thereof, a double channel member 522. The first channel 524 is open toward the top. The second channel 526 is open toward the cabinet 10 and comprises a pair U-shaped leg portions 528 and a straight web portion 530.

Figure 35:
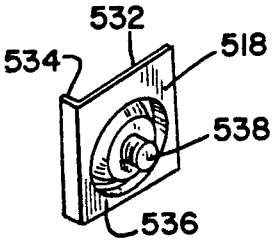
FIG. 35 is a perspective view of a first connector used to connect the work surface assembly to the cabinet in the manner shown in FIG. 33(*a*)

For the single cabinet attachment shown in FIG. 33(*a*), the work surface 512 is mounted to the cabinet 10 by a pair of first work surface connectors 518 fastened to and between the work surface and the cabinet back wall channels 196. As illustrated in FIG. 35, the connector 518 comprises a rectangular metallic plate 532 with a flange 534 extending along one end 536 thereof. An internally threaded stud 538 centered on the plate 532 and extending outwardly in a direction opposite flange 534 is rigidly mounted to the plate. To secure the work surface 512 to the cabinet 10, a connector 518 is inserted within the second channel 526 at each end thereof so each stud 538 extends toward the cabinet and the flanges 534 engage the channel web 530. The studs 538 are inserted into the aligned openings 154, 184 in back channels 196, and are secured in place by a threaded bolt (not shown). In this manner, the work surface 512 can be attached to the back wall 20 of a cabinet 10.

Figure 36:
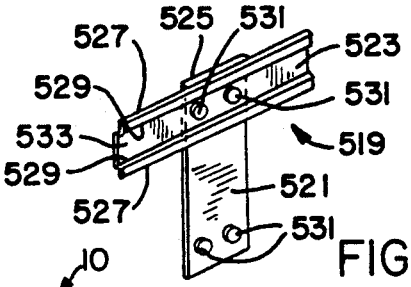
FIG. 36 is a perspective view of a second connector used to connect the work surface assembly to the pair of cabinets in the manner shown in FIGS. 33(*b*) and 33(*c*)

For attachment of the work surface 512 to a pair of cabinets 10 and 10*a* that are joined in a back-to-back or side-to-side configuration, a second work surface connector 519 is used. As illustrated in FIG. 36, the connector 519 comprises a rectangular plate 521 having a generally U-shaped cross member 523 rigidly fastened at a first end 525 of the plate 521. The cross member 523 is mounted so its longitudinal axis is perpendicular to the longitudinal axis of the plate 521. Flanges 527 extend along the lateral edges 529 of the cross member. Threaded holes 531 are positioned near each corner of the plate 521. The holes 531 near the first end 525 of plate 521 also extend through a web portion 533 of the cross member 523.

To mount the work surface 512 to the cabinets 10 and 10*a* shown in FIGS. 33(*b*) and 33(*c*), the second work surface connector 519 is slidably mounted to the work surface 512. Specifically, the connector flanges 527 are slidably mounted within the U-shaped leg portions 528 of the work surface double channel member 522. The threaded holes 531 of connector 519 are aligned with the adjacent cabinet back wall channels 196, 196*a* for cabinets in the side-to-side configuration of FIG. 33(*b*) or to adjacent cabinet side wall channels 194, 194*a* in the back-to-back configuration of FIG. 33(*c*). Bolts 535 are inserted from each cabinet through the openings in channels 194, 194*a* or 196, 196*a* and into the connector threaded holes 531. Alternatively, the second work surface connector 519 can be mounted to the cabinets prior to slidably mounting the work surface 512 to the connector 519.

Figure 37:
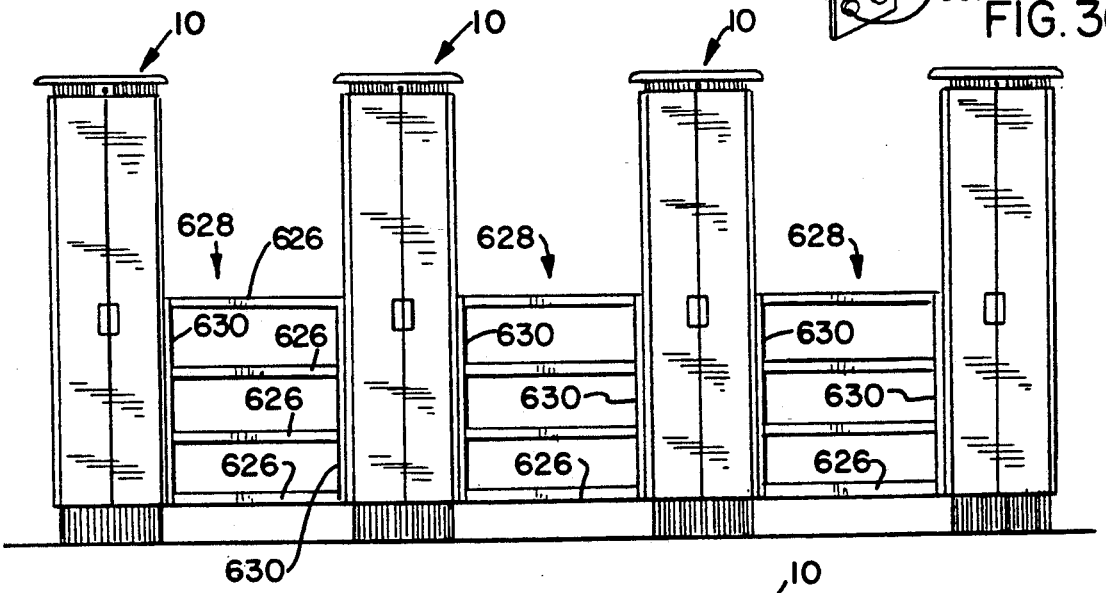
FIG. 37 is a front elevational view of a plurality of cabinets of FIG. 2 connected by a fence arrangement.

Referring to FIG. 37, there is seen an embodiment displaying a plurality of cabinets 10 and horizontal rails 626 comprising a fence arrangement 628. Specifically, vertically spaced horizontal rails 626 mount to a plurality of cabinets 10. The horizontal rails 626 are attached to the cabinets by having a plurality of vertical members 630 securely mounted to and between cabinet wall channels 194 or 196 and the horizontal rails 626 by any suitable mechanical means.

Figure 38:
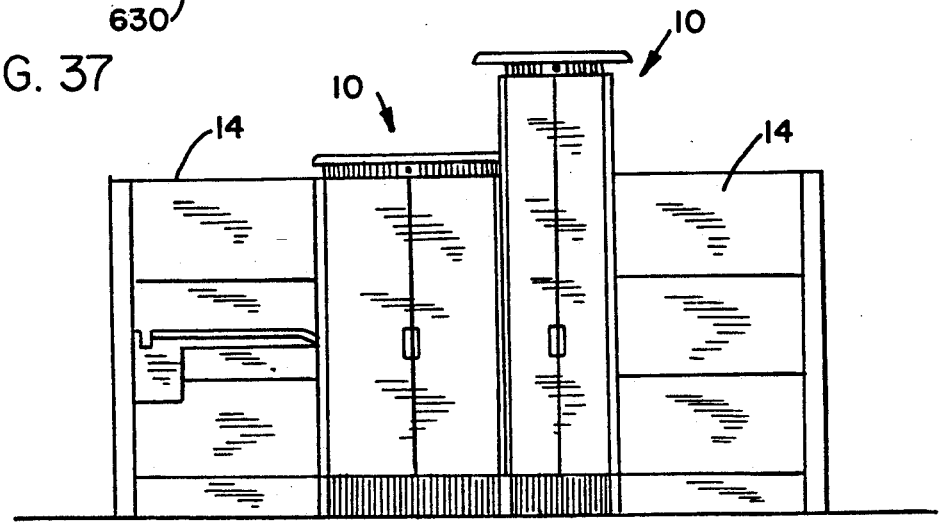
FIG. 38 is a front elevational view of a work space management system showing a pair of connected cabinets of FIG. 2 having different heights and widths.

Cabinets 10 may be manufactured having different heights and widths as shown in FIG. 38. Therefore, cabinets can be arranged so they are higher, shorter, or the same height as adjacent freestanding walls or cabinets.

Referring to all the drawings, the overall operation of the cabinet 10 will now be described. First, the type of functional arrangement between the cabinet 10 and the freestanding wall 14 and/or other cabinets 10*a* is determined. If required, wall tiles 212 are removed and any necessary holes drilled in the freestanding wall vertical frame members 208. Appropriate connectors 220, 222, 224, 226 are selected for the cabinet arrangement and installed.

In summary, the cabinet 10 can be manufactured in various sizes and can be fitted with various components to perform a variety of functions. The cabinet may be fitted with shelving, a slidable drawer, hanger rails, wardrobe hanging rods, electrical wiring to operate accessories, a lock for locking cabinet doors and an exterior work surface. In addition to being incorporated into a workspace management system, a plurality of cabinets can be connected in a fence arrangement.

A cabinet 10 can be attached to other cabinets or to a freestanding wall 14 in a variety of functional arrangements by using an appropriate connector. The inline connector 220 attaches a cabinet 10 end-on to a freestanding wall. The face connector 222 connects a cabinet to a face 304 of a freestanding wall. The centerline connector 224 attaches a pair of cabinets to a freestanding wall. Finally, a back-to-back connector 226 connects two adjacent cabinets.

While the invention has been described in connection with the preferred embodiment, the invention is not limited to that embodiment. To the contrary, the invention extends to all reasonable variations and modifications and equivalents as are included within the spirit and scope of the invention as defined by the appended claims.

We claim:

1. A cabinet for use in combination with a frame having an edge face through which said frames are joined together, said frames having at least one opening; said cabinet comprising:

a back wall, first and second side walls, a top wall and a bottom wall, all joined together to form an integral unit;

a cabinet indented channel extending vertically along at least one of said back wall and said side walls;

openings in a base portion of said cabinet indented channel;

a connector adapted to engage said channel openings in said cabinet indented channel, to engage said frame opening and to secure at least one of said frames to said cabinet.

2. A cabinet according to claim 1 wherein said frame opening is in an edge face thereof and said connector has:

block means shaped to pass through said opening in said frame in one orientation and unable to pass through said opening in said frame in a second orientation;

retainer means adapted to mount in said cabinet indented channel, said retainer means having means to grip said block means;

collar means adapted to engage said frame and having an opening to permit said retainer gripping means to pass therethrough;

said retainer means having an opening passing therethrough, said block means having a fastener receiving means; and fastener means having a longitudinal axis adapted to pass through said opening in said cabinet channel and to be retained therein, to pass through the openings in said retainer means and collar means, and to adjustably grip said fastener receiving means in said block means to draw said block means tightly into engagement with said frame in said second orientation, and to draw said frame tightly into contact with said cabinet in perpendicular orientation to the cabinet wall having said cabinet indented channel therein.

3. A cabinet according to claim 2 wherein said retainer means has arms which are shaped to be received in said cabinet indented channel and be nonrotatably retained therein; and wherein said block means is in said second orientation when said retainer means arms are in said cabinet indented channels.

4. A cabinet according to claim 3 wherein said frames have indented frame channels in said edge face and said frame opening is formed at the base of said frame channel; and said collar has flanges which are received within said indented frame channel to prevent said collar from rotating with respect to said fastener means.

5. A cabinet according to claim 4 wherein said collar further has indentations on a face adjacent to said retainer means arms; and said retainer means arms have embossments on a face adjacent to said collar; and said retainer means arms have spring means for resilient frictional engagement between said retainer means arms embossments and said indentations when said arms are rotated in contact with said collar face about said longitudinal axis of said fastener means and said block means are positioned behind said frame edge face in said second orientation.

6. A cabinet according to claim 5 wherein said fastener means comprises a bolt with a head which is larger than the opening in said cabinet indented channel, and said bolt is threaded, said fastener receiving means is a threaded opening in said block and said bolt is adapted to be threadably received in said threaded opening in said block.

7. A cabinet according to claim 1 wherein said connector is adapted to connect said frames to said side walls or back wall of said cabinet in parallel relationship thereto.

8. A cabinet according to claim 7 wherein said connector has first and second plates perpendicular to each other, said first plate adapted to be connected to an inside face of a frame and said second plate adapted to lie in facing contact with an adjacent side face of a frame, and a lug on said second plate adapted to project into said indented channel in at least one of said back wall and said side walls of side cabinet, said lug having a threaded opening adapted to receive a threaded fastener; and a threaded fastener adapted to extend through an opening in said cabinet indented channel and to threadably engage the threaded opening in said connector lug.

9. A cabinet according to claim 1 and further comprising a second connector means adapted to mount in said cabinet indented channel and to secure two identical cabinets in side-to-side, back-to-back or side-to-back relationship.

10. A cabinet according to claim 9 wherein said second connector comprises a plastic scuff-protection plate having a pair of resilient arms adapted to mount said scuff-protection plate removably in said indented channel and fastener means adapted to extend through said plate and through said indented channel to secure said cabinets together with said scuff protection plate therebetween.

11. A cabinet according to claim 1 wherein said connector comprises:

a block shaped to pass through said frame opening in one orientation and unable to pass through said frame opening in said frame in a second orientation, said block having a fastener receiving means;

retainer means with an opening therethrough for receiving a fastener;

a first fastener means having a longitudinal axis and adapted to pass through said retainer means opening and be retained therein, to pass through said frame opening, and to adjustably grip said block fastener receiving means;

blade means coupled to said retainer means, extending outwardly thereof and adapted to extend from a corner of said cabinet to said cabinet indented channel, an opening in said blade means adapted to register with said indented channel; and a second fastener means adapted to extend through the openings in said cabinet indented channel and through said blade means to secure two of said cabinets together and to a frame in abutting relationship with corners of said cabinet adjacent to said cabinet indented channels in respective cabinets.

12. A cabinet according to claim 1 wherein there is a first indented channel extending vertically along said back wall of said cabinet near the side edges thereof; and second indented channels extending along said first and second side walls near an edge adjacent to said back wall; and a second connector adapted to mount in said first and second indented channels to connect multiple of said cabinets together in back wall-to-back wall, side wall-to-side wall, or back wall-to-side wall relationship.

13. A cabinet according to claim 1 wherein said connector includes a resilient pad for mounting said edge face of said frame in abutting relationship to said cabinet and having an opening therein for registry with said one opening, and said connector means further includes a fastener adapted to extend through one of said indented channel openings and into fastening relationship with said one frame opening.

14. A cabinet according to claim 1 and further comprising vertical support members positioned within the cabinet, at a back portion of said cabinet and having a series vertically spaced slots for receiving bracket hooks to support shelves and the like.

15. A cabinet according to claim 1 wherein said cabinet further comprises a rigid framework formed of vertical frame members positioned at vertical corners of said cabinet and horizontal frame members positioned at upper and lower ends of said vertical members; and means for mounting said back wall, first and second side walls, top wall and bottom wall to said rigid framework.

16. A cabinet according to claim 15 and further comprising a series of vertically spaced slots and at least some of said vertical frame members for receiving bracket hooks to support shelves and the like within said cabinet.

17. A cabinet according to claim 1 and further comprising a work surface having at least one leg at one end thereof and means at another end thereof for mounting said work surface to said cabinet back wall.

18. A cabinet according to claim 17 wherein said work-surface mounting means comprises a plate which is received within said cabinet indented channel and a stud which is received within an opening within said vertical channel.

19. A storage cabinet comprising:

a back wall, first and second side walls, a top wall and a bottom wall, all joined together to form an integral unit;

a cabinet indented channel extending vertically along at least one of the back wall and the side walls;

openings in a base portion of the cabinet indented channel;

a connector adapted to removably mount in said cabinet indented channel and to pass through said openings in said indented channels of said cabinet in registry with an indented channel of another one of said cabinets to secure two of said cabinets together in side-to-side, back-to-back or side-to-back relationships.

20. A cabinet according to claim 19 wherein said connector comprises a plastic scuff protection plate having a pair of resilient arms adapted to mount said plate removably in said indented channel and a fastener adapted to extend through said plate and through said indented channel to secure said multiple of said cabinets together with said scuff protection plate therebetween.

21. A storage cabinet and work surface combination, said storage cabinet comprising:

a back wall, first and second side walls, a top wall and a bottom wall, all joined together to form an integral unit;

a cabinet indented channel extending vertically along at least one of said back wall and said side walls;

openings in a base portion of said cabinet indented channel;

said work surface has at least one leg at one end thereof and means at another end thereof for mounting said work surface at the other end to said back wall through said intended channel.

22. A cabinet according to claim 21 wherein said mounting means comprises a plate which is received within said cabinet indented channel and a stud which is received within one of said openings in said vertical channel.

* * * * *